US010794095B2

(12) United States Patent
Schroll

(10) Patent No.: US 10,794,095 B2
(45) Date of Patent: Oct. 6, 2020

(54) ELECTROMECHANICAL LOCK

(71) Applicant: The Eastern Company, Wheeling, IL (US)

(72) Inventor: Matthew D Schroll, Glendale Heights, IL (US)

(73) Assignee: The Eastern Company, Navgotuck, CT (US)

( * ) Notice: Subject to any disclaimer, the term of this patent is extended or adjusted under 35 U.S.C. 154(b) by 177 days.

(21) Appl. No.: 16/148,273

(22) Filed: Oct. 1, 2018

(65) Prior Publication Data

US 2019/0128027 A1 May 2, 2019

Related U.S. Application Data

(60) Provisional application No. 62/707,264, filed on Oct. 26, 2017.

(51) Int. Cl.

| | |
|---|---|
| ***E05B 81/90*** | (2014.01) |
| ***E05B 81/16*** | (2014.01) |
| ***E05B 83/26*** | (2014.01) |
| ***E05B 81/08*** | (2014.01) |
| ***E05B 17/18*** | (2006.01) |
| ***E05B 85/06*** | (2014.01) |
| ***E05B 85/10*** | (2014.01) |
| *E05B 83/18* | (2014.01) |

(52) U.S. Cl.

CPC ..... *E05B 81/90* (2013.01); *E05B 17/183* (2013.01); *E05B 81/08* (2013.01); *E05B 81/16* (2013.01); *E05B 83/26* (2013.01); *E05B 85/06* (2013.01); *E05B 85/10* (2013.01); *E05B 83/18* (2013.01); *E05Y 2900/50* (2013.01)

(58) Field of Classification Search

CPC ..... E05B 81/90; E05B 83/26; E05B 81/16; E05B 85/10; E05B 85/06; E05B 81/08; E05B 17/183; E05B 83/18; E05B 47/0603; E05B 47/0623; E05B 47/0661; E05Y 2900/50

USPC ... 70/92, 210, 215–217, 224, 375, 465, 277, 70/278.7, 279.1, 280–283; 292/21, 92

See application file for complete search history.

(56) References Cited

U.S. PATENT DOCUMENTS

| | | | | |
|---|---|---|---|---|
| 3,062,033 A | 11/1962 | Schmalfeldt | ..... | E05B 83/16 70/256 |
| 3,321,226 A | 5/1967 | DeClaire et al. | ..... | E05B 81/20 292/65 |
| 3,992,909 A | 11/1976 | McGhee | ..... | E05B 3/00 70/379 |

(Continued)

*Primary Examiner* — Lloyd A Gall
(74) *Attorney, Agent, or Firm* — David A. Burge; Benjamin D. Burge

(57) ABSTRACT

A lock includes: a plug housing rotatable about a central axis to unlatch a closure when the lock is in an unlocked state, wherein the plug housing defines a plug passage therein along the central axis and an intersecting pin slot through a side wall thereof; a plug rotatable within the plug passage to transition the lock between unlocked and locked states, wherein an inner portion thereof defines a helical groove that extends into the intersection of the plug passage and pin slot; and a stop linearly movable parallel to the central axis between inward and outward positions to place the lock in unlocked and locked states, respectively, wherein a stop pin of the stop extends through the pin slot and into the helical groove to interact therewith such that turning the plug causes the stop to linearly move between the inward and outward positions.

22 Claims, 26 Drawing Sheets

(56) References Cited

U.S. PATENT DOCUMENTS

| | | | | |
|---|---|---|---|---|
| 4,080,812 | A | 3/1978 | Knott | E05B 65/12 70/256 |
| 4,155,233 | A | 5/1979 | Lira | E05B 65/19 70/92 |
| 5,711,559 | A | 1/1998 | Davis | E05B 15/02 292/340 |
| 6,086,131 | A | 7/2000 | Bingle et al. | B62D 25/12 296/76 |
| 6,189,351 | B1 * | 2/2001 | Eagan | E05B 13/101 292/DIG. 27 |
| RE37,290 | E | 7/2001 | David | B60L 1/14 307/10.8 |
| 6,390,529 | B1 | 5/2002 | Bingle et al. | B62D 25/10 296/76 |
| 6,394,511 | B1 | 5/2002 | Lam et al. | E05C 19/18 292/336.3 |
| 6,412,318 | B1 * | 7/2002 | Shen | E05B 47/0661 70/217 |
| 6,460,906 | B2 | 10/2002 | Bingle et al. | E05B 3/00 292/336.3 |
| 6,485,081 | B1 | 11/2002 | Bingle et al. | E05B 65/10 296/76 |
| 6,692,056 | B2 | 2/2004 | Bingle et al. | B62D 25/12 296/76 |
| 6,832,793 | B2 | 12/2004 | Bingle et al. | E05B 3/00 292/336.3 |
| 7,363,786 | B2 | 4/2008 | Terhaar et al. | B60R 25/02 70/208 |
| 7,523,970 | B2 | 4/2009 | Konchan | E05B 1/00 292/347 |
| 7,918,114 | B2 * | 4/2011 | Walsh, III | E05B 47/0661 70/283 |
| 8,302,438 | B2 * | 11/2012 | Lui | E05B 47/0012 70/277 |
| 8,474,290 | B2 | 7/2013 | Terhaar et al. | E05B 47/06 70/92 |
| 2011/0132047 | A1 * | 6/2011 | Terhaar | E05B 83/26 70/91 |

* cited by examiner

ELECTROMECHANICAL LOCK

REFERENCE TO PROVISIONAL APPLICATION

This Utility Patent Applications claims the benefit of the filing date of Provisional Application Ser. No. 62/707,264 filed Oct. 26, 2017 by Matthew D. Schroll, and entitled ELECTROMECHANICAL LOCK, the disclosure of which is incorporated herein by reference in its entirety.

BACKGROUND

The present invention relates to the field of locks to secure relatively large enclosable spaces used to store various objects, specifically for enclosable spaces incorporated into vehicles, such as the externally accessible storage compartments thereof. Examples of such enclosable spaces include, and are not limited to, externally accessible storage compartments incorporated into service vans, construction site work vehicles, fire engines, ambulances, etc.; externally accessible storage compartments that are formed on a vehicle by the addition of a lockable cover to an otherwise normally open storage compartment, as in the case of a hinged tonneau cover added to the cargo bed of a pickup truck; and externally accessible storage compartments incorporated into passenger vehicles, such as the trunk of a car, or the rear hatch door of a station wagon or a sport utility vehicle (SUV).

Such vehicle compartments have long incorporated a wide variety of locks. Most of such locks incorporate key locks in which a key is used to place the lock into an unlocked state that enables a closure of such an enclosable space to be unlatched. Some of such locks incorporate a separate and distinct operating handle to unlatch the closure, while others rely on the same operation of the key that causes unlocking to also cause unlatching of the closure such that the key may effectively become the operating handle while it remains inserted into the lock. For sake of convenience of use, it has long been common practice for such locks to be configured to behave as or otherwise serve as components of "slam latch" systems in which the act of closing a closure (e.g., a door, a trunk lid, a hatch door, a hinged tonneau cover, etc.) is all that is needed to at least latch the closure in a closed position, if not also to cause the simultaneous locking of the closure.

Such locks have also long incorporated a mechanism by which the lock may be at least unlocked, if not also unlatched, remotely by operation of a button or switch located on or near a control console within the passenger cab of a vehicle. A well known example of this is the incorporation of a button in a glove compartment of a passenger vehicle by which the lock on a hinged trunk door or rear hatch door may be simultaneously unlocked and unlatched without the use of a key, which is often the same key that is inserted into the ignition switch to enable driving of the vehicle. Such buttons or switches are often connected by electric cabling or even pneumatic tubing to the lock, to which an electrically operated solenoid or pneumatically operated piston, respectively, has been added to effect such simultaneous unlocking and unlatching in response to operation of such buttons or switches. More recently, it has become commonplace for vehicles to incorporate wireless receivers by which wireless signals from a wireless remote control may be used as the trigger to cause such simultaneous unlocking and unlatching, either in lieu of, or in addition to, such buttons or switches.

As will be familiar to those skilled in the art, although many of such enclosable spaces incorporated into vehicles are intended for the storage of such items as spare tires, luggage, jobsite tools and/or other objects, many of the larger forms of such enclosable spaces have long presented a danger of trapping persons therein. Again, many of such enclosable spaces employ "slam latch" systems in which the act of closing a closure is all that is needed to at least latch the closure in a closed position, if not also to cause the closure to be locked in the closed position. Also, such closures are often hinged closures that must be opened in a generally upward direction against the force of gravity, thereby creating the risk of the closure falling back down into a closed position where their "slam latch" mode of operation may trap a curious child or other person therein. Unfortunately, deaths have resulted because a child or adult became trapped within such an enclosable space for an extended period of time and/or under circumstances where sunlight raised the temperature of such an enclosable space to a deadly level. In response to these incidents, laws now require locks used with many of such enclosable spaces to incorporate an emergency handle that is manually operable from within such an enclosable space by someone trapped therein to release themselves.

As a result of the now commonplace expectation that such locks should be capable of being remotely simultaneously unlocked and unlatched, and as a result of the now mandatory addition of an emergency handle to enable the escape of a trapped person, the complexity of such locks has considerably increased in recent years. As a result, there has been a tendency of such locks to occupy ever more of the interior volume of such enclosable spaces. However, as will be familiar to those skilled in the art, larger vehicles generally require more material to build and are generally less energy efficient such that making a vehicle larger than is necessary to perform its intended function is usually deemed undesirable. As a result, it is usually deemed desirable to make the trunks of cars, enclosable cargo beds of pickup trucks and/or other enclosable spaces of vehicles any larger than deemed necessary, and to configure such enclosable spaces to enable as effective and full utilization of their interior volumes as possible. Thus, it is usually deemed desirable for locks that may be installed on the closures of such enclosable spaces to not take up any more of the interior volume of such enclosable spaces than is necessary.

Another difficulty created by the addition of such remote control functionality and of such emergency handles is the greater complexity of the process of installing such locks. It has long been common practice to form a relatively small aperture through the closures of such enclosable spaces, and to install such a lock by inserting it in fully assembled form or nearly fully assembled form through that aperture, and securing it in place therethrough. However, the addition of solenoid(s) and/or an emergency handle sometimes necessitates additional steps in the installation process, which can become considerable time consumption and labor cost issues in the mass production of vehicles.

Therefore, a need exists for a relatively compact and easily assembled lock that is both remotely operable, and manually operable from both outside and inside such an enclosable space.

SUMMARY

The present invention addresses such needs and deficiencies as are explained above by providing an electromechanical lock for securing a vehicle closure (e.g., a tonneau cover, a rear hatch door, or a trunk lid), or other closure of a enclosable space or compartment with an interior volume large enough to trap at least a child, is able to be either manually or remotely locked or unlocked, and is able to be operated from within such an enclosable space to unlatch such a closure regardless of whether the lock is in a locked or unlocked state. The lock is configured for installation through a relatively small opening formed through such a closure such that a manually external operable handle and keyway of the lock are accessible from outside the enclosable space, and such that a manually operable emergency handle is accessible from inside the enclosable space.

BRIEF DESCRIPTION OF THE DRAWINGS

A fuller understanding of what is disclosed in the present application may be had by referring to the description and claims that follow, taken in conjunction with the accompanying drawings, wherein:

FIG. 10 is a conceptual block diagram, from a side of an enclosable space having a hinged closure with the lock of FIGS. 1A and 1B installed thereon, and showing the closure in both open and closed positions.

DETAILED DESCRIPTION

Figure 1A:
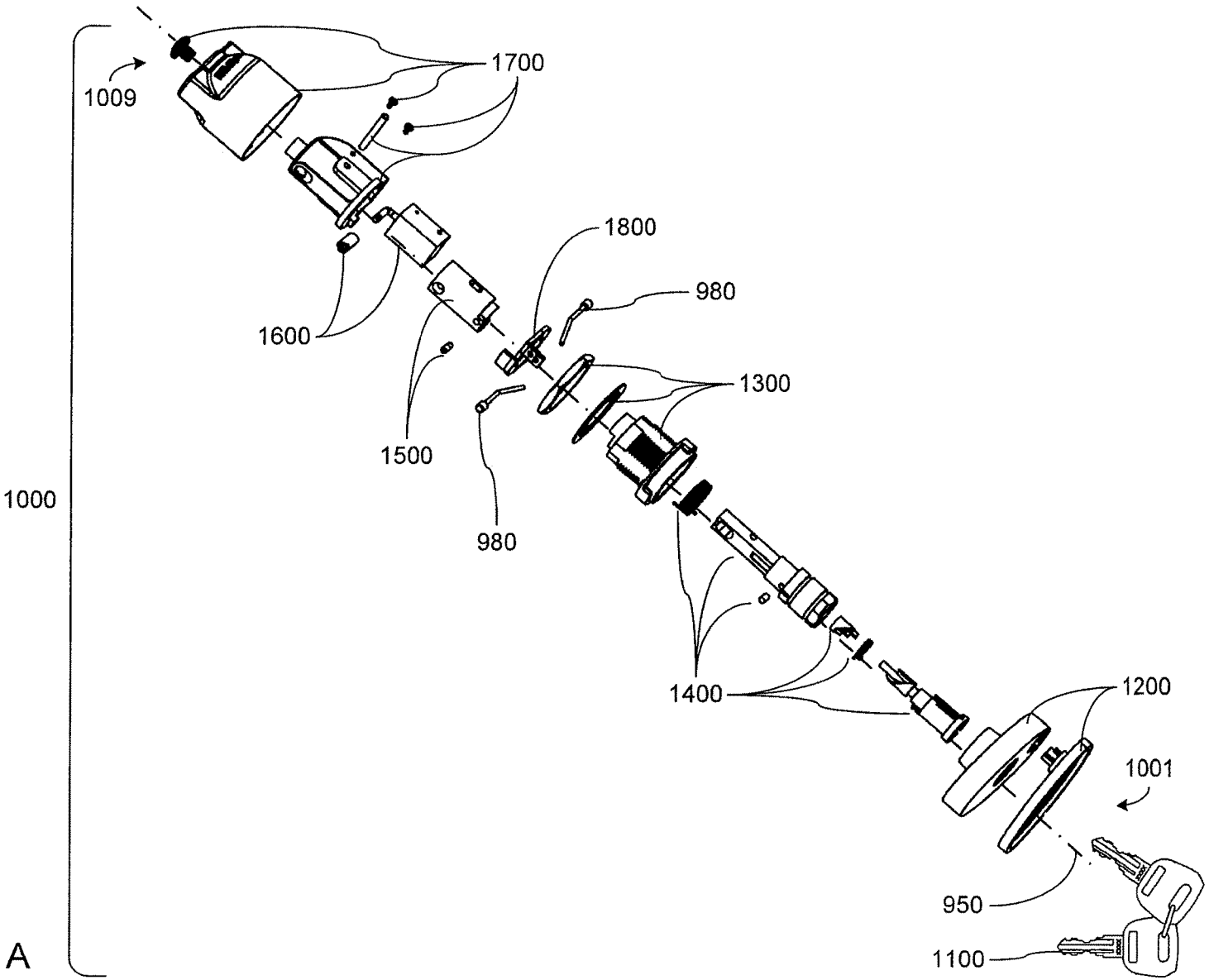
FIG. 1A is an exploded perspective view, from an outer end and a side, and extending along a central axis, of most of the components of a first example embodiment of a lock in an unassembled state, along with at least one key for the operation thereof.
Figure 1B:
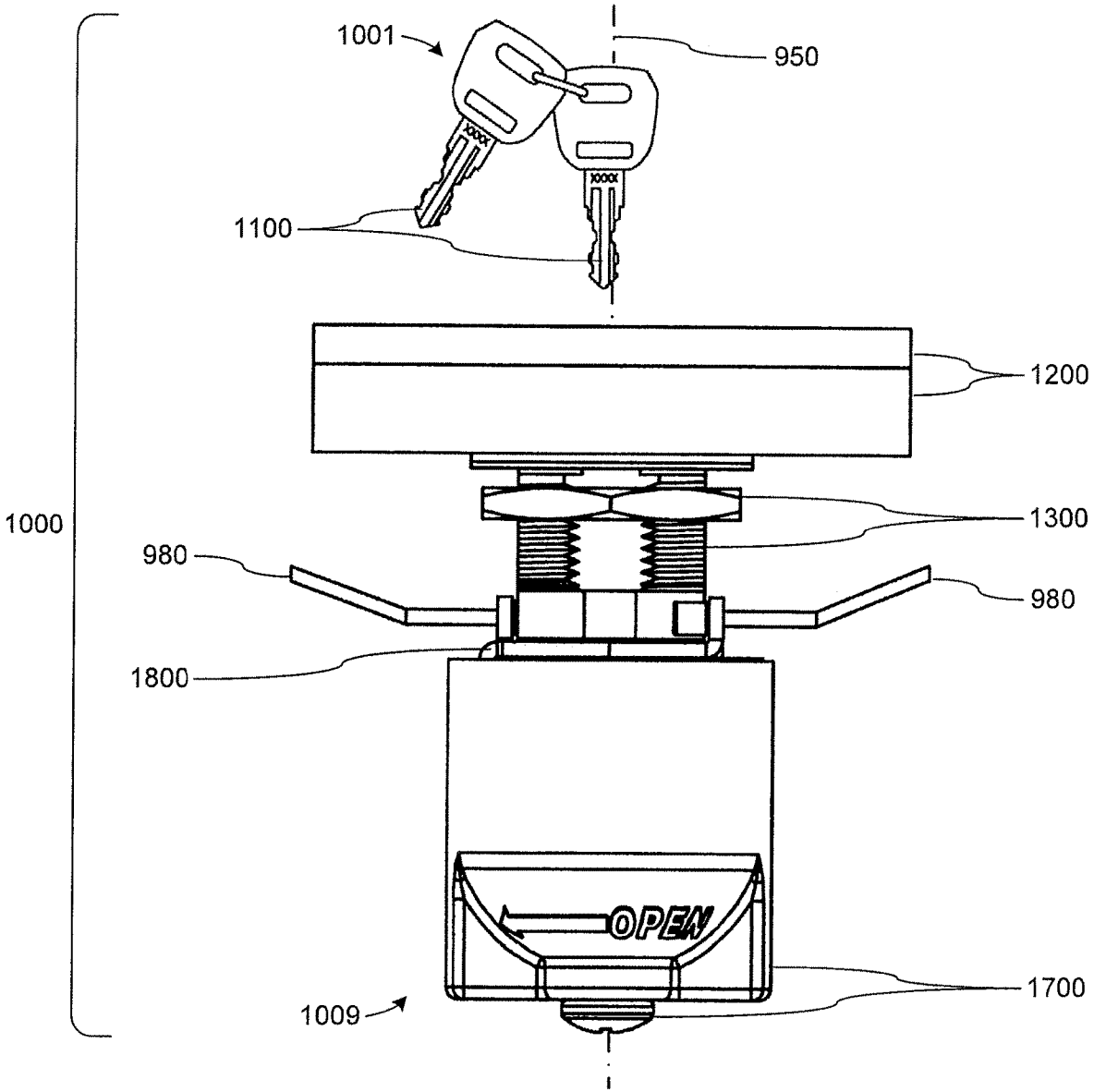
FIG. 1B is an elevational view, from a side, of the lock of FIG. 1A in an assembled state, along with the key(s).
Figure 1C:
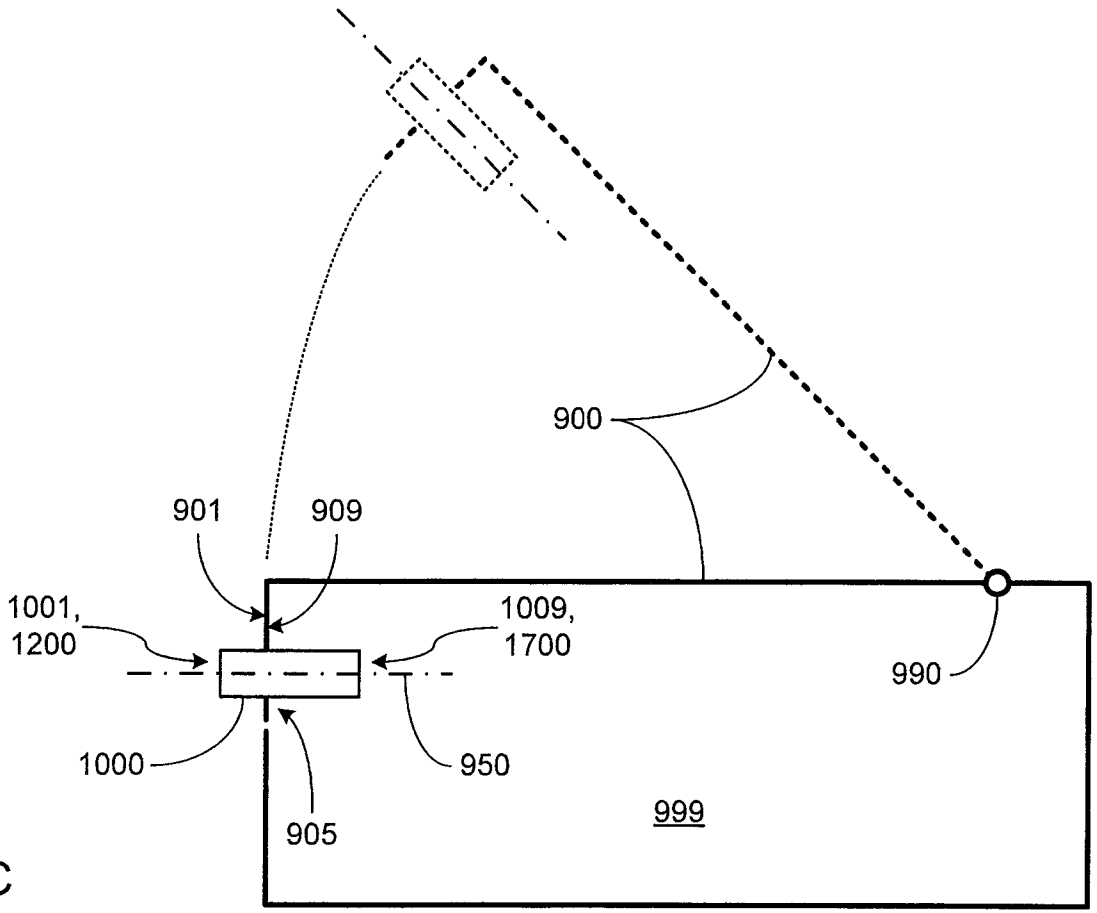

FIGS. 1A through 1C, together, depict aspects of a novel electromechanical lock 1000 that addresses the aforementioned needs. As depicted in FIG. 1A, the lock 1000 may incorporate one or more keys 1100, a handle 1200, a barrel assembly 1300, a plug assembly 1400, a stop assembly 1500, a solenoid assembly 1600, a body assembly 1700 and a latch assembly 1800. As depicted in FIG. 1B, and as will be described in greater detail, when assembled, many of the components of the lock 1000 are rotatable about a central axis 950 to selectively place the lock 1000 in either a locked state or an unlocked state, and/or to effect unlatching to open a closure 900 of an enclosable space 999, such as an enclosable compartment of a vehicle.

FIG. 10 provides a relatively simplified conceptual depiction of a possible use of the lock 1000. As will be described in greater detail, the lock 1000 may be installed within an opening 905 formed through a portion of the closure 900 of a vehicle, such as the trunk lid of a trunk of a car, a rear hatch door of a station wagon or SUV, or a hinged tonneau cover for a cargo bed of a pickup truck. In such a use, the closure 900 may be a hinged closure in which another portion thereof is attached to a portion of the body of a vehicle via a hinge 990. That portion of the body of the vehicle, along with other portions of the body of the vehicle, may define enclosable space 999 to which the closure 900, with the lock 1000, may be used to limit access. The portion of the closure 900 through which the opening 905 is formed may define an outer surface 901 of the closure 900 that faces outwardly away from the enclosable space 999, and an inner surface 909 of the closure 900 that faces inwardly toward the enclosable space 999. Thus, the opening 905 is formed through both of the surfaces 901 and 909 such that each of the surfaces 901 and 909 extend around the opening 905.

As is typical for such closures as trunk lids, hatch doors and tonneau covers, opening the closure 900 to gain access to the enclosable space 999 may entail pivoting the closure 900 generally upward against the force of gravity about an axis of a hinge, such as the hinge 990. As will be familiar to those skilled in the art, the hinge 990 may incorporate and/or be accompanied by other components (e.g., torsion springs, pneumatic cylinders, mechanical stops, etc.—not shown) that may serve to maintain the closure 900 in an upwardly extending open position to which the closure 900 may have been moved as part of opening the closure 900 to gain access to the enclosable space 999. However, it is known for such other components to fail such that the closure 900 may subsequently be allowed to fall back down to its original closed position, and it is known for such events to occur unexpectedly such that a person may become unexpectedly trapped within the enclosable space 999.

As also depicted in FIG. 10, when installed within the opening 905 formed through a portion of the closure 900, an outer portion 1001 of the lock 1000 that includes the handle 1200 may extend outwardly from the opening 905, generally along the central axis 950, beyond the outer surface 901 of the closure 900, and into the environment external to the enclosable space 999 (also the environment external to the vehicle that includes the enclosable space 999). Correspondingly, an inner portion 1009 of the lock 1000 that includes the body assembly 1700 may extend inwardly from the opening 905, also generally along the central axis 950, beyond the inner surface 909 of the closure 900, and further into the interior volume of the enclosable space 999. As will be explained in greater detail, the handle 1200 may be manually operable by a person outside the enclosable space 999, at a time when the lock 1000 is in an unlocked state, to unlatch the closure 900 as part of opening the closure 900 to gain access to the enclosable space 999. Correspondingly, a portion of the body assembly 1700 may serve as an emergency handle that may be manually operable by a person within the enclosable space 999 to unlatch the closure 900 as part of opening the closure 900 to enable their escape from therein, and may be so operable regardless of whether the lock 1000 is in a locked state or an unlocked state.

Referring back to FIGS. 1A and 1B, and as will be explained in greater detail, the key(s) 1100 may be employed by a person outside of the enclosable space 999 to selectively place the lock 1000 in either a locked state or an unlocked state. The locked and unlocked states are differentiated by movement of the stop assembly 1500 into and out of engagement with a portion of the barrel assembly 1300, thereby selectively preventing and allowing turning of at least the handle 1200, the plug assembly 1400 and the latch assembly 1800 of the lock 1000 to pull in a pair of latch cables 980 to operate latches (not shown) to unlatch the closure 900.

However, as will also be explained in greater detail, a solenoid of the solenoid assembly 1600 may be electrically operated from a location beyond the vicinity of the lock 1000 to also selectively place the lock 1000 in either the locked state or the unlocked state. In some embodiments, the electrical signals for such operation of the lock 1000 may emanate from elsewhere within the vehicle associated with the closure 900 and the enclosable space 999, such as from the location of a manually operable electrical switch within a passenger cab of the vehicle. In other embodiments, the electrical signals for such operation of the lock 1000 may emanate from a circuit incorporated into the vehicle that includes a wireless receiver to receive a signal emanating from a remote control or other device that conveys a command to place the lock 1000 in either the locked state or unlocked state. Such a wireless signal may be a radio frequency (RF) signal, a signal carried by light waves (e.g., infrared (IR) signaling), a signal carried by sound (e.g., ultrasonic signaling), etc.

It should be noted that, throughout the present application, the terms "inner", "inwardly extending", "outer" and "outwardly extending" are used to provide an indication of orientation and/or relative location of various components and/or portions of components of the lock 1000 along the central axis 950 and/or relative to the interior volume of the enclosable space 999. More specifically, various components are described herein as having an outer end, outer portion or outwardly extending portion that extends along the central axis 950 toward, and/or faces outwardly (as does the outer surface 901 of the closure 900) from, the interior volume of the enclosable space 999 and toward the environment external to the enclosable space 999 (which, again, may also be the environment external to the vehicle that incorporates the enclosable space 999). Correspondingly, various components and/or portions of components of the lock 1000 are described herein as having an inner end, inner portion or inwardly extending portion that extends along the central axis 950 toward or further into, and/or faces toward (as does the inner surface 909 of the closure 900), the interior volume of the enclosable space 999. Such use of the terms "inner" and "outer" are intended to impart greater clarity to descriptions herein of orientation and/or relative location of components, and should not be taken as limiting.

Figure 2B:
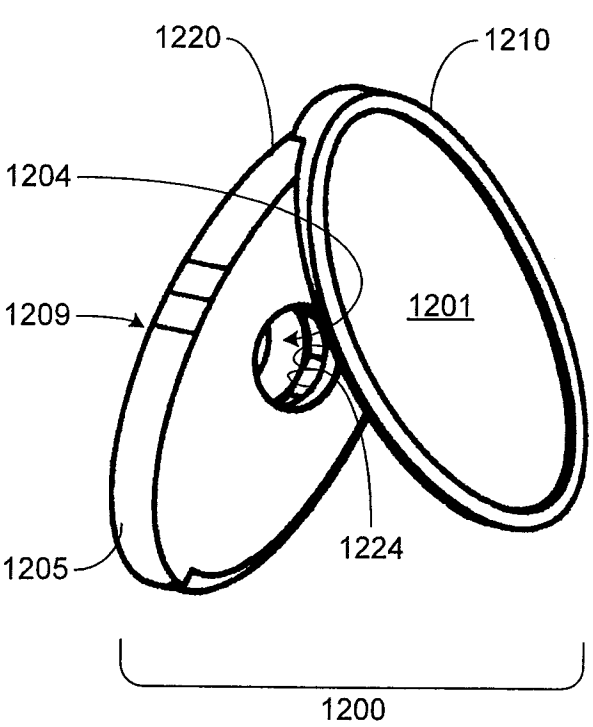
FIG. 2B is a perspective view, also from the outer end and a side, of the external handle of FIG. 2A, with the handle cover pivoted to an open position relative to the handle housing to enable access to a plug passage formed through the handle housing in which may be positioned a plug assembly carrying a key cylinder that provides a keyway to receive one the keys to operate the key cylinder to place the lock in a locked or unlocked state.
Figure 2A:
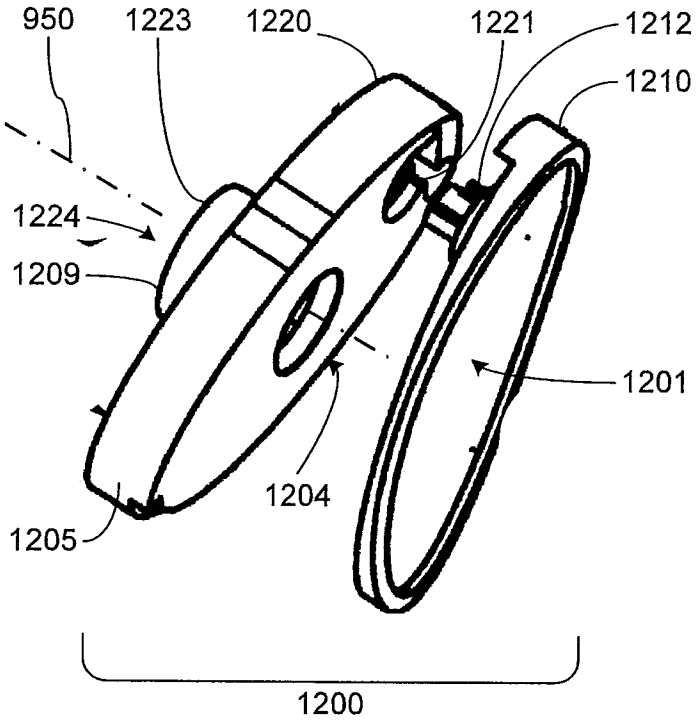
FIG. 2A is an exploded perspective view, from an outer end and a side, of components of an embodiment of an external handle of the lock of FIGS. 1A-C, showing details of a handle housing and optional handle cover thereof.

FIGS. 2A and 2B, together, depict aspects of an example embodiment of the handle 1200 operable by a person outside of the enclosable space 999 (e.g., as by grasping and turning the handle 1200 about the central axis 950) to effect unlatching of the closure 900 when the lock 1000 is in an unlocked state. As depicted in FIGS. 2A-B, the handle 1200 may incorporate both a handle housing 1220 and a handle cover 1210. As previously discussed, the handle 1200 forms part of the outer portion 1001 of the lock 1000. Indeed, the handle 1200 may make up the bulk of the outer portion 1001 of the lock 1000. Further, in this depicted embodiment of the handle 1200, an outer face 1201 of the handle cover 1210 may provide the outermost face of the outer portion 1001 of the lock 1000 when the outer portion 1001 is viewed from outside the closure 900.

Continuing to refer to both FIGS. 2A and 2B, the handle housing 1220 may include an outer portion 1205 and an inwardly extending portion 1209. With the lock 1000 assembled and installed through the opening 905 formed through a portion of the closure 900, the inwardly extending portion 1209 may extend inwardly along the central axis 950 toward opening 905. In so doing, the inwardly extending portion 1209 may serve to space the outer portion 1205 away from the outer surface 901 of the closure 900, thereby better enabling a person outside of the enclosable space 999 to more fully grasp more of the outer portion 1205 in preparation for turning the handle 1200 about the central axis 950 (when the lock 1000 is in an unlocked state) to effect unlatching of the closure 900.

A plug passage 1204 may be formed through both the outer portion 1205 and the inwardly extending portion 1209 of the handle housing 1220, following a path through the handle 1200 that is selected to extend along the central axis 950. The plug passage 1204 may be configured to receive and surround an outer portion 1403 of a plug housing 1490 of the plug assembly 1400 (best viewed in FIG. 4A). Referring more specifically to FIG. 2B, the plug passage 1204 may incorporate one or more mating formations 1224 to engage corresponding mating formations 1492 formed on the outer portion 1403 of the plug housing 1490 when the outer portion 1403 is inserted into the plug passage 1204 through the inwardly extending portion 1209 during assembly of the lock 1000. The engagement of the mating formations 1224 and 1492 within the plug passage 1204 may cause the plug housing 1490 to turn together with the handle housing 1220 when the handle 1200 is manually turned about the central axis 950 by a person outside of the enclosable space 999 to effect unlatching of the closure 900.

Returning to both FIGS. 2A and 2B, the depicted example embodiment of the handle 1200 has a generally oval shape with the central axis 950 extending generally through the center of the oval shape. However, other embodiments of the handle 1200 are possible that may have any of a variety of other shapes, including, but not limited to, other relatively simple geometric shapes such as a circular or rectangular shape. Also, in other embodiments of the handle 1200, the central axis 950 may extend therethrough at a location other than through its center such that other embodiments of the handle 1200 may be operable to turn about the central axis 950 in a manner more akin to a lever. Still other configurations of the handle 1200 will occur to those skilled in the art.

In the depicted example embodiment of the handle 1200, the handle cover 1210 may be pivotable about another axis that may extend parallel to the central axis 950 to selectively cover the plug passage 1204. As will be explained in greater detail, the outer portion 1403 of the plug housing 1490 may carry a plug 1444 that may provide a keyway 1411 (best viewed in FIGS. 4A and 4C) that becomes accessible through the plug passage 1204 when the outer portion 1403 of the plug housing 1490 is inserted therein as has been described. The handle cover 1210 may serve the purpose of selectively covering the plug passage 1204, thereby selectively covering the keyway 1411 to prevent dust, moisture and debris from entering the keyway 1411 and thereby impairing operation of the lock 1000. The handle cover 1210 may be biased by a spring (not shown) to pivot to, and be retained at, a position at which the handle cover 1210 covers the plug passage 1204. Thus, the handle cover 1210 may need to be turned against such a biasing force and away from such a covering position to gain access to the keyway 1411 to enable insertion of the key 1100 therein.

In other embodiments, the handle cover 1210 may pivot about one or more different and/or additional axes relative to the handle housing 1220, and/or may be movable relative to the handle housing 1220 in ways other than by pivoting (e.g., by sliding relative thereto). In still other embodiments, the handle 1200 may not incorporate any form of the handle cover 1210, whatsoever.

Figure 3B:
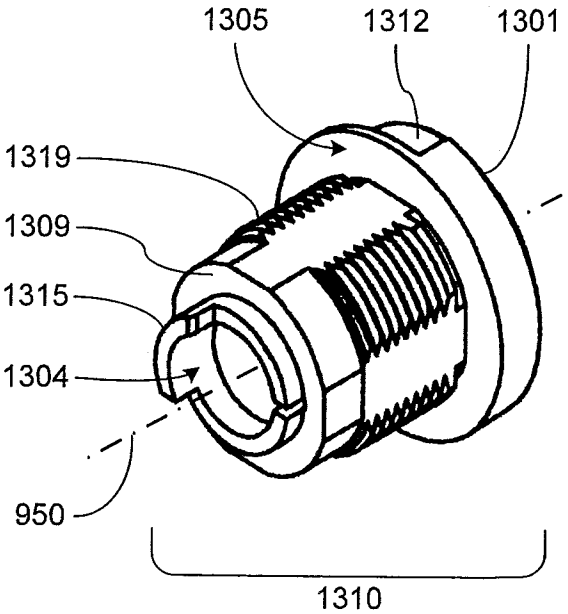
FIG. 3B is a perspective view, from an inner end and a side, of the barrel of FIG. 3A, showing details of a plug passage through which the aforementioned plug assembly may extend, and within which the aforementioned plug assembly may rotate. Also shown are details of a locking formation formed on the inner end of the barrel to be engaged by a corresponding locking formation of a stop to selectively prevent or allow turning of the aforementioned plug assembly within the plug passage of the barrel, along with turning of the handle assembly of FIGS. 2A-B relative to the outer end of the barrel, thereby serving to implement the locked and unlocked states, respectively, of the lock of FIGS. 1A-B.
Figure 3A:
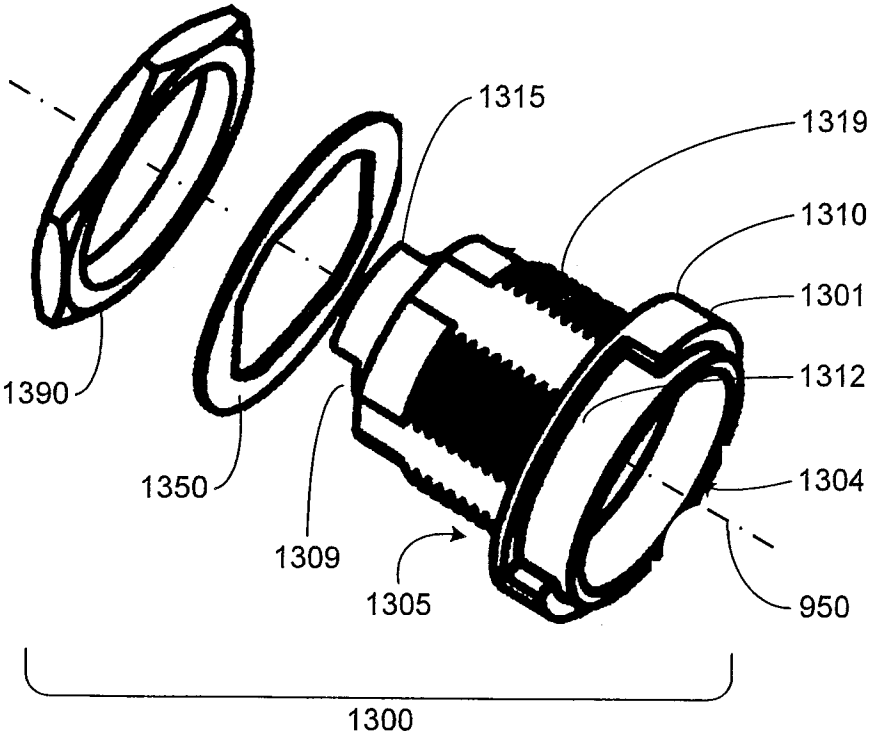
FIG. 3A is an exploded perspective view, from an outer end and a side, of components of a barrel assembly of the lock of FIGS. 1A-C, showing details of a barrel, a gasket and a barrel nut thereof. Also shown are details of a limiting formation of the barrel to engage a corresponding limiting formation of the handle housing of the handle assembly of FIGS. 2A-B to limit turning of the handle assembly relative to the outer end of the barrel.

FIGS. 3A and 3B, together, depict aspects of an example embodiment of the barrel assembly 1300 for use in mounting the lock 1000 within the opening 905 formed through a portion of the closure 900. As depicted in FIG. 3A, the barrel assembly 1300 may incorporate a barrel 1310, a gasket 1350 and a barrel nut 1390.

Referring to FIGS. 3A and 3B, the barrel 1310 includes an outer end 1301 and an inner end 1309, and defines a plug passage 1304 opening through and extending between both of the ends 1301 and 1309. The barrel 1310 is configured to be installed within the opening 905 of the closure 900 as part of installing the lock 1000 on the closure 900. With the barrel 1310 so installed, the path of the plug passage 1304 may serve to define the location and orientation of the central axis 950 as extending through the opening 905 of the closure 900. Also, with the barrel 1310 so installed, the outer end 1301 extends outwardly from the opening 905 and away the interior volume of the enclosable space 999 along axis 950. Correspondingly, the inner end 1309 extends inwardly from the opening 905 and into the interior volume of the enclosable space 999 along the central axis 950.

The outer end 1301 of the barrel 1310 may carry a flange-like structure surrounding where the plug passage 1304 opens through the outer end 1301 of the barrel 1310, and defining a shoulder 1305 that faces inward toward the portion of the outer surface 901 of the closure 900 that surrounds the opening 905. The barrel 1310 may be configured to be installed within the opening 905 of the closure 900 by the inner end 1309 being inserted into the opening 905 from the side of the outer surface 901, and by such insertion of the barrel 1310 progressing sufficiently far through the opening 905 as to bring the shoulder 1305 into direct contact with the outer surface 901 of closure 900. Alternatively, in some embodiments, the gasket 1350 may be interposed between the outer surface 901 and the shoulder 1305 to provide more of an airtight and watertight seal between the barrel 1310 and the opening 905 to prevent the infiltration of dust, debris and/or water therebetween and into the enclosable space 999 from the environment outside thereof.

The inner end 1309 of the barrel 1310 may carry a locking formation 1315 that may be selectively engaged by a corresponding locking formation of a stop 1550 of the stop assembly 1500 to selectively place the lock 1000 in either of a locked state or an unlocked state, as will be explained in greater detail. As depicted, the locking formation 1315 may have a generally annular shape that surrounds and/or defines the opening at the inner end 1309 to the plug passage 1304, and that may form the portion of the inner end 1309 that extends furthest inward toward the enclosable space 999 along the central axis 950 when the barrel 1310 is installed within the opening 905. As also depicted, the locking formation 1315 and other portion(s) of the inner end 1309 may cooperate to define a relatively flat, annular shoulder surface that concentrically surrounds the locking formation 1315 as the locking formation 1315 surrounds the opening at the inner end 1309 to the plug passage 1304.

The barrel 1310 may carry a set of threads 1319 on exterior portions of the barrel 1310 between the shoulder 1305 and the inner end 1309. The barrel nut 1390 may be configured to be threaded onto the threads 1319 after insertion of the barrel 1310 through the opening 905 to secure the barrel 1310 in place within the opening 905. More specifically, the barrel nut 1390 may be threaded over the inner end 1309 of the barrel 1310, and onto the threads 1319 until the barrel nut 1390 is pressed into contact with the portion of the inner surface 909 of the closure 900 that surrounds the opening 905. Through tightening of the barrel nut 1390 on the threads 1319 against the inner surface 909, the shoulder 1305 of the barrel 1310 may be tightened against the portion of outer surface 901 that surrounds the opening 905 (either directly, or indirectly with the gasket 1350 interposed therebetween).

The aforementioned flange-like structure surrounding where the plug passage 1304 opens through the outer end 1301 of the barrel 1310 may, alternatively or additionally, carry a limiting formation 1312. With the lock 1000 installed through opening 905 of closure 900, the limiting formation 1312 may engage a limiting formation 1223 carried by the inwardly extending portion 1209 of handle 1200 to limit the extent of turning of the handle housing 1220 and plug housing 1490 about the central axis 950. More specifically, such engagement between the limiting formations 1312 and 1223 may define the extent to which the handle 1200 may be turned about the central axis 950 to effect unlatching of the closure 900 when the lock 1000 is in an unlocked state.

Figure 4A:
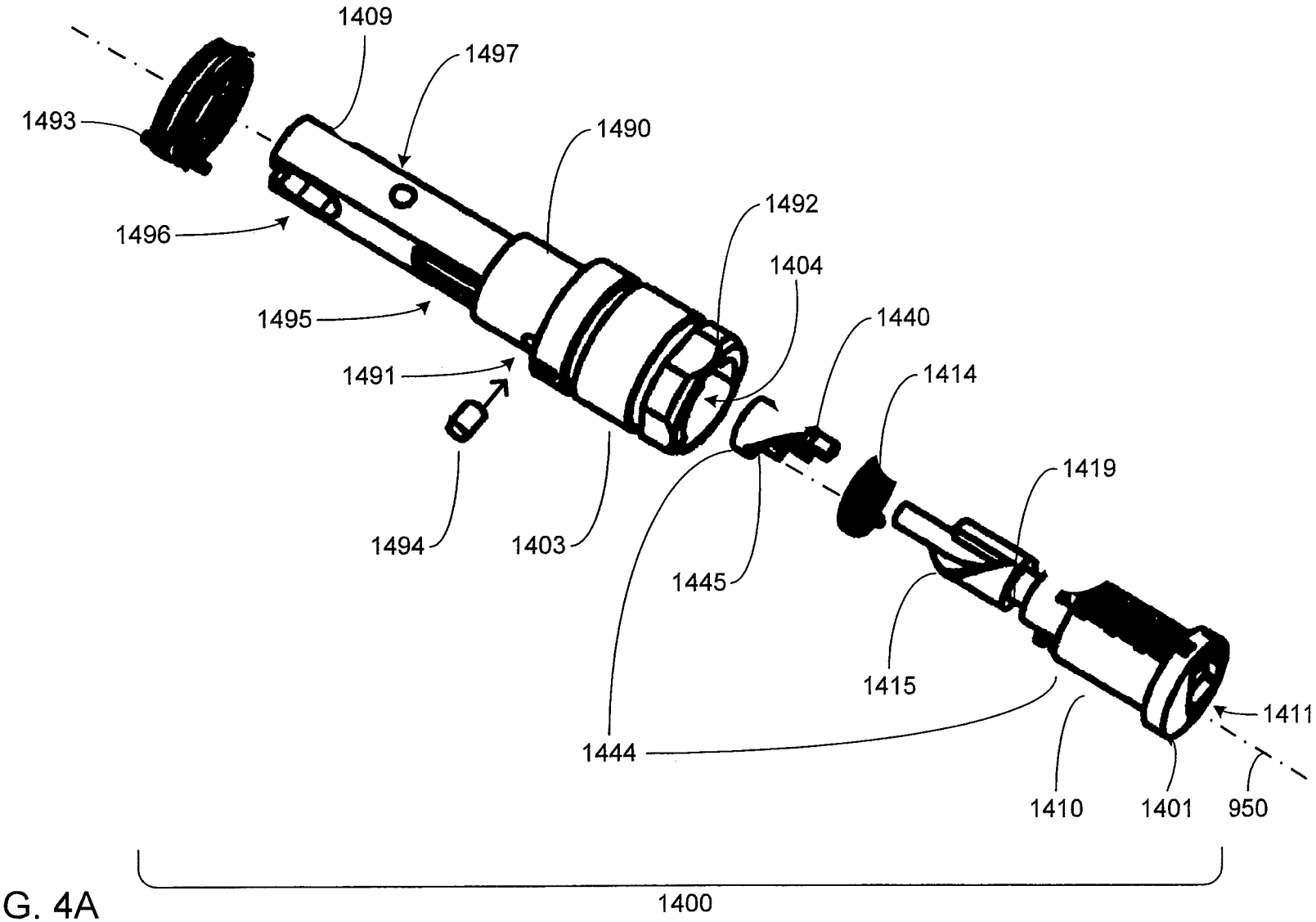
FIG. 4A is an exploded perspective view, from an outer end and a side, of components of the aforementioned plug assembly of the lock of FIGS. 1A-C, showing details of a plug, a plug housing, a plug spring and a handle spring thereof. Also shown are details of mating formations carried by an outer end of the plug housing to engage corresponding mating formations carried within the plug passage of the handle housing of FIGS. 2A-B to cause the plug housing and the handle of FIGS. 2A-B to turn together relative to the barrel of FIGS. 3A-B about the central axis.
Figure 4B:
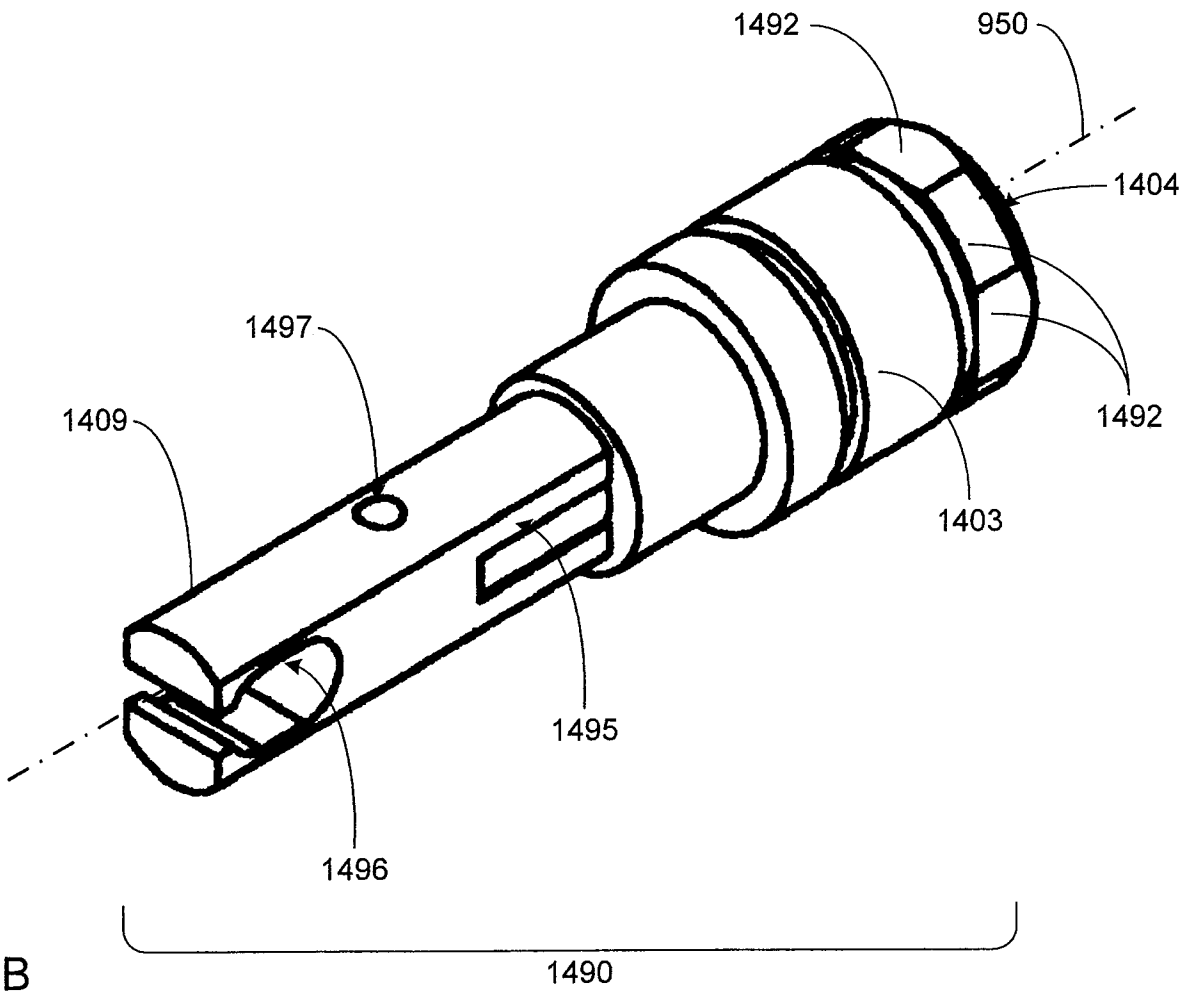
FIG. 4B is a perspective view, from an inner end and a side, of the plug housing of FIG. 4A, showing details of an armature slot through which an armature of a solenoid may extend to operate the aforementioned stop to selectively prevent or allow turning of the plug housing and the handle of FIGS. 2A-B relative to the barrel of FIGS. 3A-B about the central axis as part of placing the lock of FIGS. 1A-C into either of the locked or unlocked states, respectively.
Figure 4C:
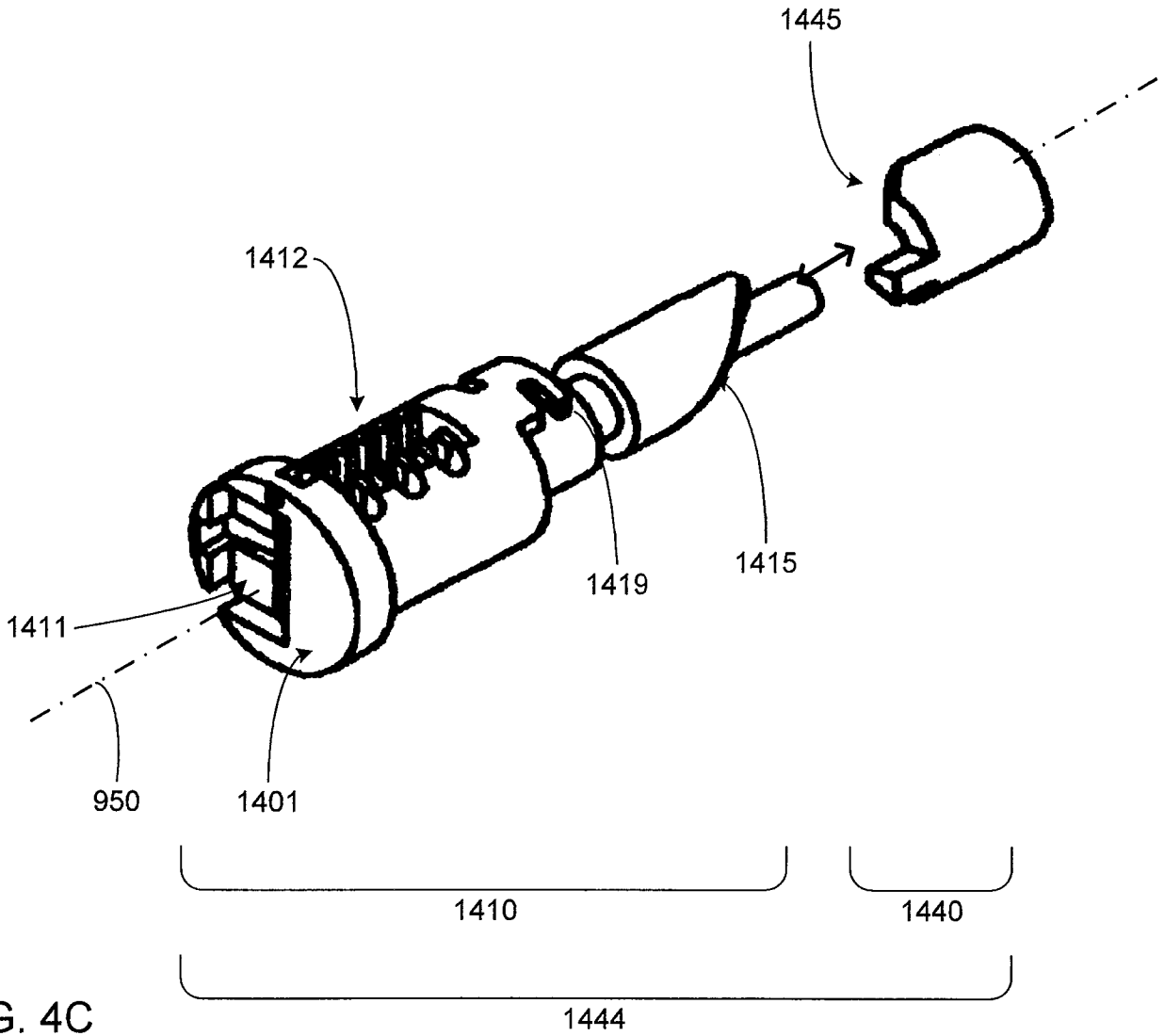
FIG. 4C is a perspective view, from an outer end and a side, of the plug of FIG. 4A, which includes the aforementioned key cylinder. Also shown are details of a pair of opposed helical surfaces that cooperate to define a helical groove into which a stop pin carried by the aforementioned stop may extend to also enable operation of the stop to control turning of plug housing and of the handle of FIGS. 2A-B relative to the barrel of FIGS. 3A-B about the central axis.

FIGS. 4A through 4C, together, depict aspects of an example embodiment of the plug assembly 1400 for use in controlling placement of the lock 1000 in either a locked state or an unlocked state. As is shown in FIG. 4A, the plug assembly 1400 may incorporate the aforementioned plug 1444 and plug housing 1490.

As depicted in FIGS. 4A and 4B, the plug housing 1490 includes the aforementioned outer end 1403 and an inner end 1409. As previously discussed, the plug housing 1490 is configured to extend through, and to turn about the central axis 950 within, the plug passage 1304 formed through the barrel 1310 when the lock 1000 is assembled. With the lock 1000 assembled, at least a portion of the outer end 1403 extends outwardly along the central axis 950 (again, as defined by the plug passage 1304 of the barrel 1310) beyond the outer end 1301 of the barrel 1310, and at least a portion of the inner end 1409 extends inwardly along the central axis 950 beyond the inner end 1309 of the barrel 1310. With the lock 1000 installed within the opening 905, as well as assembled, at least a portion of the outer end 1403 extends outwardly along the central axis 950 beyond the opening 905 and away from the enclosable space 999, and the inner end 1409 extends inwardly along the central axis 950 beyond the opening 905 and further into the enclosable space 999.

As previously discussed, in addition to the plug housing 1490 extending through the plug passage 1304 formed through the barrel 1310, the outer end 1403 of plug housing 1490 is configured to extend into the plug passage 1204 formed through the handle housing 1220 when the lock 1000 is assembled. Again, the outer end 1403 of the plug housing 1490 may carry the aforementioned mating formations 1492 to engage the corresponding mating formations 1224 within the plug passage 1204 of the handle housing 1220 to cause the plug housing 1490 and the handle housing 1220 to turn together about the central axis 950 and relative to the barrel 1310.

Continuing to refer to FIGS. 4A and 4B, the plug housing 1490 defines a plug passage 1404 to rotatably carry the plug 1444 therein. The plug passage 1404 may be formed through the outer end 1403 and partially into the inner end 1409 of the plug housing 1490 where the plug passage 1404 is intersected by a pin slot 1495 that extends transversely through the inner end 1409 and across the plug passage 1404. When the plug housing 1490 is inserted into the plug passage 1304 of the barrel 1310, the plug passage 1404 may be caused to extend through the outer portion 1403 along the central axis 950, and the pin slot 1495 may be caused to extend through the inner portion 1409 across the central axis 950. Thus, with the plug housing 1490 so installed within the plug passage 1304, and with the plug 1444 inserted into the plug passage 1404, the plug 1444 may be caused to extend along and be turnable about the central axis 950 therein.

As depicted in FIGS. 4A and 4C, the plug 1444 may be formed as two separate components that may be subsequently assembled, specifically an outer plug portion 1410 and an inner plug portion 1440. Such formation of the plug 1444 as two separate components may be to avoid the complexities and/or expense of molding or using some other fabrication process to form the entirety of the plug 1444 as a single piece with both the depicted helical surface 1415 of the outer plug portion 1410 and the depicted helical surface 1445 of the inner plug portion 1440. The opposed helical surfaces 1415 and 1445 may cooperate to define a helical groove 1405 (best viewed in FIGS. 11A through 11D).

Continuing to refer to FIGS. 4A and 4C, with the plug 1444 inserted into the plug passage 1404 such that an outer face 1401 of the plug 1444 becomes accessible where the plug passage 1404 opens through the outer end 1403 of the plug housing 1490, the helical groove 1405 may be made accessible via the pin slot 1495. As will be explained in greater detail, a stop pin 1510 carried by the aforementioned stop 1550 of the stop assembly 1500 may extend into the pin slot 1495 to interact with the helical groove 1405, and such interaction may include the conversion of rotary motion of plug 1444 about the central axis 950 within the plug passage 1404 into linear motion of the stop 1550 along the exterior of inner portion 1409 of the plug housing 1490 in parallel with axis 950.

As previously discussed, the plug 1444 may define the keyway 1411 to receive key(s) 1100 to selectively place the lock 1000 in a locked state or an unlocked state. More specifically, the keyway 1411 may be formed through the outer face 1401 of the outer portion 1410 of the plug 1444. When the outer end 1403 of the plug housing 1490 is inserted into the plug passage 1204 of the handle housing 1220 through the inner portion 1209, the outer face 1401 of the outer end 1403 may become visible and accessible where the opposite end of plug passage 1204 opens through the handle housing 1220. In this way, the keyway 1411 may become visible and accessible such that a person outside the enclosed space 999 may insert one of the keys 1100 therein.

Referring to FIG. 4C, the keyway 1411 may be transversely intersected by a tumbler cavity 1412. The tumbler cavity 1412 may hold one or more spring-biased tumblers (not shown) to be engaged by one of the keys 1100 upon insertion thereof into the keyway 1411. In a manner that will be familiar to those skilled in the art, such one or more spring-biased tumblers may engage interior surface(s) of the plug passage 1404 to selectively lock the plug 1444 in place against being turned within, and relative to, the plug passage 1404. In a manner that will also be familiar to those skilled in the art, insertion of a properly configured one of the keys 1100 may interact with such one or more tumblers to selectively enable the plug 1444 to be turned within, and relative to, the plug passage 1404 to thereby selectively place the lock 1000 in a locked state or an unlocked state (e.g., a key 1100 with a preselected combination of teeth, groove, pins and/or indentations that positions the tumblers in a preselected manner relative to the interior surface(s) of the plug passage 1404).

Following the provision of such one or more spring-biased tumblers within the tumbler cavity 1412, the plug 1444 may be inserted as previously described into the plug passage 1404. In some embodiments, a retention pin 1494 may be inserted through a pin passage 1491, which may transversely intersect with the plug passage 1404, to engage a retention groove 1419 formed in the outer portion 1410 of plug 1444. In such embodiments where the plug 1444 is initially formed as the two separate portions 1410 and 1440 prior to being assembled to form the plug 1444, such use of the retention pin 1494 and the retention groove 1419 may serve to use the confined space of the plug passage 1404 to hold the two portions 1410 and 1440 of the plug 1444 together.

As depicted in FIG. 4A, in some embodiments, a plug spring 1414 may be sleeved over the plug 1444 prior to insertion of the plug 1444 into the plug passage 1404 of the plug housing 1490. The plug spring 1414 may interact with both the plug 1444 and the interior surface(s) of the plug passage 1404 of the plug housing 1490 to spring-bias the plug 1444 into a predetermined rotary orientation within the plug passage 1404. In such embodiments, the plug 1444 may be so spring-biased to a neutral rotary orientation at which no action may be effected to transition the lock 1000 between locked and unlocked states. Additionally, in this neutral orientation the tumbler(s) within the tumbler cavity 1412 may act against interior surface(s) of the plug passage 1404 to lock the plug 1444 against being turned away from the neutral orientation. Thus, such a neutral orientation may be a default orientation to which the plug 1444 is spring-biased by the plug spring 1414 to return to when no key 1100 is used to cause turning of the plug 1444 away from such a neutral orientation, and the plug 1444 may become locked at such a neutral orientation upon being returned thereto by the plug spring 1414.

As is also shown in FIG. 4A, in some embodiments, a handle spring 1493 may be sleeved over the plug housing 1490 prior to insertion of the plug housing 1490 into the plug passage 1304 of the barrel 1310. The handle spring 1493 may interact with both the plug housing 1490 and the interior surface(s) of the plug passage 1304 to spring-bias the plug housing 1490 and the handle housing 1220 into a predetermined rotary orientation relative to the barrel 1310. In such embodiments, the plug housing 1490 and the handle housing 1220 may be so spring-biased to a rotary orientation at which no action may be effected to effect unlatching of closure 900. Additionally, it may be in this orientation at which plug housing 1490 and handle housing 1220 may be selectively locked against turning such that handle 1200 is prevented from being turned to effect such unlatching.

Figure 5B:
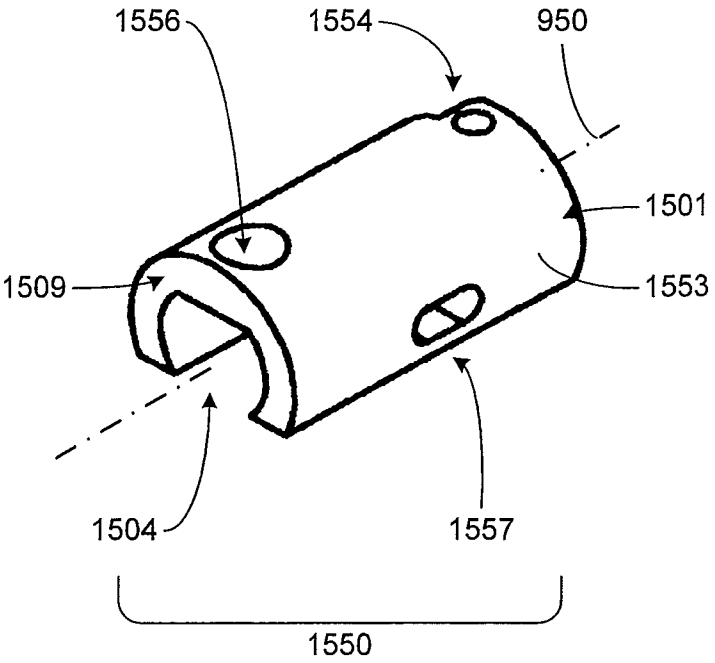
FIG. 5B is a perspective view, from an inner end and a side, of the stop of FIG. 5A, showing details of a slide channel by which the stop is slidably carried along an inner portion of the plug housing of FIGS. 4A-B to enable the locking formation formed on the outer end of the stop to be moved into and out of engagement with the corresponding locking formation formed on the inner end of the barrel of FIGS. 3A-B.
Figure 5A:
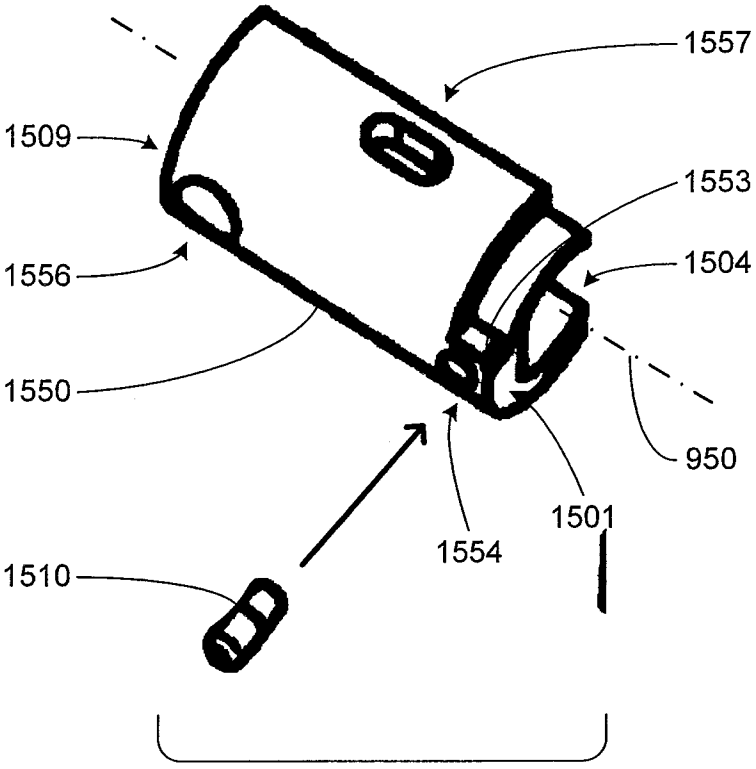
FIG. 5A is an exploded perspective view, from an outer end and a side, of components of a stop assembly of the lock of FIGS. 1A-C, showing details of the aforementioned stop and the aforementioned stop pin thereof. Also shown are details of the aforementioned locking formation formed on the outer end of the stop to engage the corresponding locking formation formed on the inner end of the barrel of FIGS. 3A-B to control turning of the handle assembly of FIGS. 2A-B and of the plug assembly of FIGS. 4A-C relative to the barrel as part of selectively placing the lock in a locked or unlocked state.

FIGS. 5A and 5B, together, depict aspects of an example embodiment of the stop assembly 1500 for use in selectively the placing lock 1000 in a locked state by which the closure 900 is unable to be unlatched through operation of the handle 1200. As depicted in FIG. 5A, the stop assembly 1500 may incorporate the aforementioned stop pin 1510 and the aforementioned stop 1550.

Referring to FIGS. 5A and 5B, the stop 1550 includes an outer end 1501 and an inner end 1509, and defines a slide channel 1504 that opens through and extends between the ends 1501 and 1509 to partly surround the inner portion 1409 of the plug housing 1490. The stop 1550 is configured to be sleeved onto the inner portion 1409 of the plug housing 1490 in a slip fit that allows the stop 1550 to slide linearly along the length thereof. As depicted, the slide channel 1504 may shaped to closely follow contours of the external surface(s) of the inner portion 1409 of the plug housing 1490

(best viewed in FIG. 4B). As a result, with the lock 1000 assembled, the stop 1550 is caused to turn about the central axis 950 along with the plug housing 1490 and the handle housing 1220 when the lock 1000 is in an unlocked state and the handle 1200 is manually operated to unlatch the closure 900.

A pin passage 1554 may be formed through a portion of the outer end 1501 into which the stop pin 1510 may be installed to extend therefrom and into the slide channel 1504. The stop pin 1510 may be so installed within the pin passage 1554 after the stop 1550 has been sleeved onto the inner portion 1409 of the plug housing 1490 far enough to align the pin passage 1554 with the pin slot 1495 of the inner portion 1409, and far enough to align the pin passage 1554 with the helical groove 1405 of the plug 1444 through the pin slot 1495. With the stop pin 1510 so installed such that the stop pin 1510 extends through the pin passage 1554, the through pin slot 1495, and into the helical groove 1405, rotary movement of the plug 1444 may cause may cause one or the other of the helical surfaces 1415 or 1445 of the helical groove 1405 to engage the stop pin 1510. Through such engagement, rotary movement of the plug 1444 within the plug passage 1404 may be converted into linear movement of the stop 1550 along the length exterior of the inner portion 1409 of the plug housing 1490.

With the plug housing 1490 inserted into and extending through the plug passage 1304 of the barrel 1310, with the stop 1550 so sleeved onto the inner portion 1409 of the plug housing 1490, and with the stop pin 1510 so installed within the pin passage 1491 to so engage the helical slot 1405, that path of such linear movement of the stop 1550 along the length of the inner portion 1409 is caused to parallel the central axis 950. As previously discussed, under such conditions, such linear movement of the stop 1550 in parallel with the central axis 950 may selectively bring the aforementioned locking formation 1553 carried on the outer end of the stop 1550 into engagement with the corresponding locking formation 1315 carried on the inner end 1309 of the barrel 1310. Thus, such linear movement of the stop 1550 caused by turning of the plug 1444 under control of one of the keys 1100 may selectively lock the plug housing 1490 and the handle housing 1220 against turning relative to the barrel 1310 about the central axis 950 such that the handle 1200 may be selectively prevented from being operated (turned relative to the barrel 1310 about the central axis 950) to unlatch the closure 900.

Figure 6:
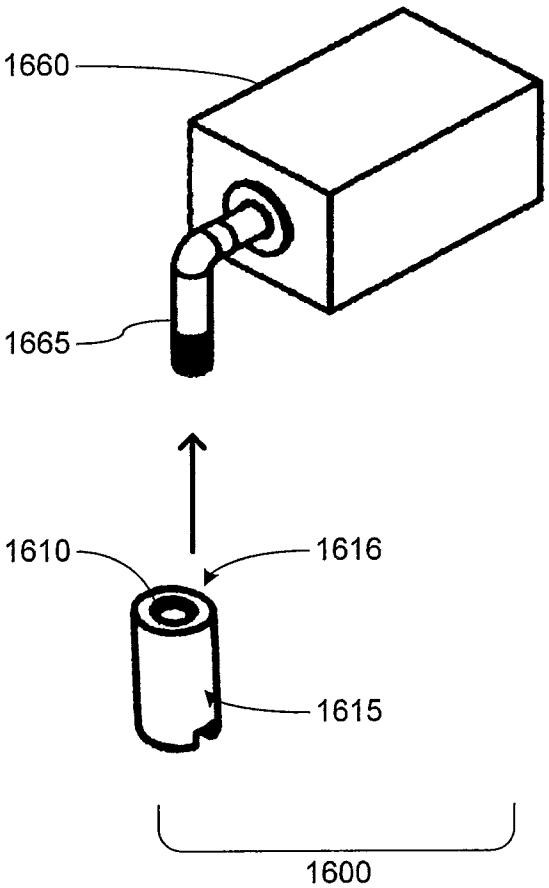
FIG. 6 is an exploded perspective view, from an inner end and a side, of components of a solenoid assembly of the lock of FIGS. 1A-C, showing details of the aforementioned solenoid and an optional armature connector by which the aforementioned armature of the solenoid may be connected to the stop of FIGS. 5A-B to cause sliding movement of the stop along the inner portion of the plug housing of FIGS. 4A-B. Again, through such sliding movement of the stop, the locking formation formed on the outer end of the stop may be brought into and out of engagement with the corresponding locking formation formed on the inner end of the barrel of FIGS. 3A-B.

FIG. 6 depicts aspects of an example embodiment of the solenoid assembly 1600 for use in selectively sliding the stop 1550 along the length of the inner portion 1409 of the plug housing 1490 under the control of electrical signals. As depicted, the solenoid assembly 1600 may incorporate an armature connector 1610 and the aforementioned solenoid 1660.

As will be explained in greater detail, in assembling the lock 1000, the solenoid 1660 may be positioned alongside the inner portion 1409 of the plug housing 1490. In some embodiments, such positioning of the solenoid 1660 may be along a side of the inner portion 1409 that is not included in the partial surrounding of the inner portion 1409 by the stop 1550. In this way, the solenoid 1660 remains out the way of, and does not interfere with, the linear movement of the stop 1550 along the inner portion 1409. Stated differently, in assembling the lock 1000, the solenoid 1660 and the stop 1550 may be positioned along opposing sides of the inner portion 1409 of the plug housing 1490.

The solenoid 1660 includes an armature 1665 which may be moved magnetically and/or in other ways by other components of the solenoid 1660 (e.g., electromagnetic coils) in response to the receipt of electrical signals conveyed to the solenoid 1660 by electrical wires (not shown). In some embodiments, when the stop 1550 and the solenoid 1660 are assembled together with the plug housing 1490, an end portion of the armature 1665 may extend through an armature slot 1496 formed through the inner portion 1409 of the plug housing 1490 (best viewed in FIG. 4B), and into an armature passage 1556 formed through the inner end 1509 of stop 1550 (best viewed in FIGS. 5A-B). In such embodiments, such an end portion of the armature 1665 may be directly and snugly received within the armature passage 1556, thereby enabling the solenoid 1660 to be operated to directly move the stop 1550 linearly along the length of the inner portion 1409 of plug housing 1490. It should be noted that the armature slot 1496 may be shaped and/or sized to avoid interfering with the linear movement of the armature 1665 effected by other components of the solenoid 1660 to cause such linear movement of the stop 1550.

However, in other embodiments, an end portion of the armature 1665 may be connected to the stop 1550 more indirectly through the armature connector 1610 installed on the end portion. More specifically, the end portion of armature 1665 may be externally threaded to enable the armature connector 1610 to be threaded thereon. The armature connector 1610 may define a threaded cavity 1616 incorporating threads to interact with the threads formed on the end portion of the armature 1665 to enable such threading thereon. The armature connector 1610 may be of substantially cylindrical shape defining a substantially cylindrical side wall 1615. The cylindrical side wall 1615 may be received within the armature passage 1556 with a relatively snug fit, thereby connecting the armature 1665 to the stop 1550 to thereby move the stop 1550 linearly along the length of the inner portion 1409 of the plug housing 1490 under control of the solenoid 1660.

It should be noted that, the solenoid 1660 may be selected to be of a type that offers minimal resistance against the armature 1665 being moved at times when the solenoid 1660 is not being electrically operated to, itself, move the armature 1665. Stated differently, at times when the solenoid 1660 is not being provide with an electric signal to cause the solenoid 1660 to move the armature 1665 to cause sliding movement of the stop 1550, the solenoid may provide little or no resistance against similar linear movement of the stop 1550 (and with it, the armature 1665) that is caused by operation of other component(s) of the lock 1000, such as the earlier described conversion of rotary movement of the plug 1444 into linear movement of the stop 1550 by interactions between the stop pin 1510 and the helical groove 1405.

As has been discussed, with lock 1000 assembled, the stop 1550, the plug housing 1490 and the handle housing 1220 are caused to rotate together about the central axis 950 when the lock 1000 is in an unlocked state and the handle 1200 is manually operated to unlatch the closure 900. With the armature 1665 connecting the solenoid 1660 to the stop 1550 through the armature slot 1496 of the inner portion 1409 of the plug housing 1490, the solenoid 1660 is also caused to so rotate with the stop 1550, the plug housing 1490 and the handle housing 1220 about the central axis 950. Since the solenoid 1660 thusly turns about the central axis 950 at times when the lock 1000 is in an unlocked state and the handle 1200 is manually turned to unlatch the closure 900, ends of electrical wire leads (not shown) that bring electrical signals to the solenoid 1660 to control its operation may need be made flexible enough to move with the solenoid 1660 as the solenoid 1660 is so turned. However, it is believed that the benefits of providing the solenoid 1660 with the relatively direct, mechanically simple, and therefore more robust mechanical connection to the stop 1550 that is described above outweigh any disadvantage of imposing such a requirement on such electrical wire leads. Such benefits additionally include providing the lock 1000 with a smaller overall size than prior art locks in which a solenoid is mounted in a manner that does not turn about any axis.

Figure 7:
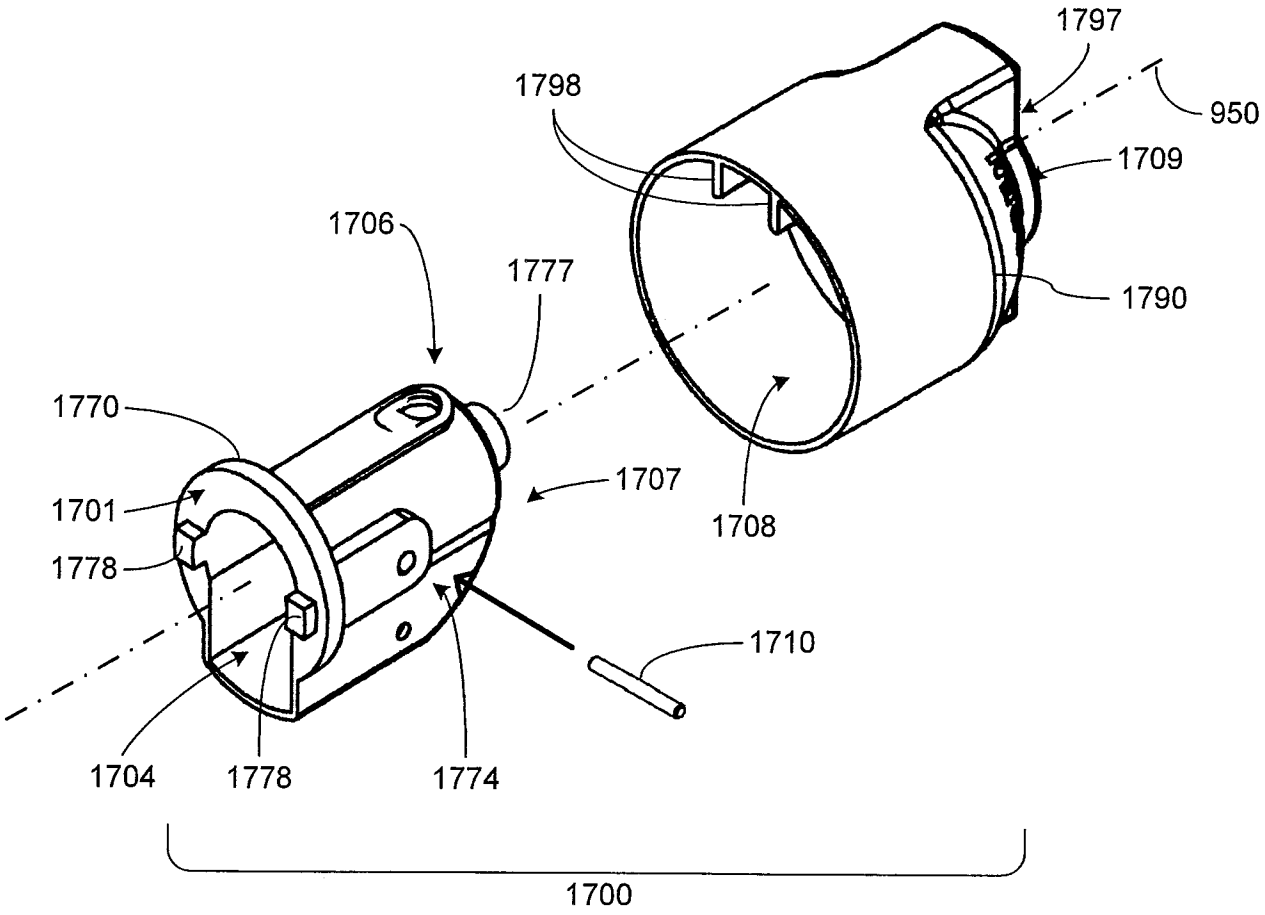
FIG. 7 is an exploded perspective view, from an outer end and a side, of components of a body assembly of the lock of FIGS. 1A-C, showing details of a body shell to closely surround the combination of the inner portion of the plug assembly of FIGS. 4A-B, the stop assembly of FIGS. 5A-B and the solenoid assembly of FIG. 6. Also shown are details of a pair of engagement formations carried on an outer end of the body shell to engage a latch ring to enable unlatching of the closure of FIG. 10 while the lock is in an unlocked state. Further shown are details of a body cover to surround the body shell, and to serve as an emergency handle rotatable about the central axis, and relative to the body shell, as well as relative to the barrel of FIGS. 3A-B, to cause unlatching of the closure regardless of whether the lock is in a locked or unlocked state.

FIG. 7 depicts aspects of an example embodiment of the body assembly 1700 for use in protectively covering components of the lock 1000 and providing an emergency handle operable from within the enclosable space 999. As depicted, the body assembly 1700 may incorporate a cross pin 1710, a body shell 1770 and a body cover 1790.

The body shell 1770 includes an outer end 1701 and an inner end 1707, and defines a cavity 1704 that opens through the outer end 1701 to receive the inner portion 1409 of the plug housing 1490 with the stop 1550 and the solenoid 1660 positioned on opposite sides of the inner portion 1409 as previously discussed. At least the inner portion 1409 and the stop 1550 may be retained within the cavity 1704 by the insertion of the cross pin 1710 through a pin passage 1774 formed through one side of the body shell 1770, a pin slot 1557 formed through one part of stop 1550 (best viewed in FIGS. 5A and 5B), a pin passage 1497 formed through inner portion of the plug housing 1490, through another pin slot 1557 formed through another part of the stop 1550, and through another pin passage 1774 formed through an opposite side of the body shell 1770.

The extension of the armature 1665 from the solenoid 1660 through the armature slot 1496 of the inner portion 1409 of the plug housing 1490, and into the armature passage 1556 of the stop 1550 may serve to retain the solenoid 1660 within the cavity 1704 along with the inner portion 1409 and the stop 1550. However, other fasteners may be employed to assist in retaining the solenoid 1660, such as screw(s) extending through a side of the body shell 1770 (best viewed in FIG. 1A) and into the solenoid 1660. Also, as depicted, the cavity 1704 may be shaped and sized to closely surround the combination of the inner portion 1409 of the plug housing 1490, the stop 1550 and the solenoid 1660. Regardless of the exact manner in which this combination of components is retained within the cavity 1704 of the body shell 1770, such insertion and retention of this combination of components therein may result in the body shell 1770 rotating with this combination of components, as well as with the handle 1200, about the central axis 950 when the lock 1000 is in an unlocked state. In this way, turning of the handle 1200 while the lock 1000 is in an unlocked state causes turning of the body shell 1770 as part of causing unlatching the closure 900, as will be explained in greater detail.

Each of the pin slots 1557 formed through part of the stop 1550, and through which the cross pin 1710 extends, may be shaped and sized to not interact with the cross pin 1710 in a manner that would restrict the linear movement of stop 1550 along the length of the inner portion 1409 of the plug housing 1490. Thus, while the installation of the cross pin 1710 through the pin passages 1774 and 1497, as well as through the pin slots 1557 as described above, may aid in retaining the stop 1550 in its position within the cavity 1704 and alongside the inner portion 1409 of plug housing 1490, the installation of the cross pin 1710 does not impede the linear motion of the stop 1550 to selectively bring the lock formation 1553 of stop 1550 into engagement with the lock formation 1315 of the barrel 1310 to selectively place the lock 1000 in either of a locked state or an unlocked state.

In some embodiments in which the armature 1665 is connected to the stop 1550 with the armature connector 1610, the armature connector 1610 may be threaded onto the end of the armature 1665 that extends into the armature passage 1556 of the stop 1550 before the combination of the solenoid 1660, the stop 1550 and the inner portion 1409 of the plug housing 1490 are inserted into the cavity 1704 of the body shell 1770. However, in other embodiments in which the armature 1665 is connected to the stop 1550 with the armature connector 1610, the combination of the solenoid 1660, the stop 1550 and the inner portion 1409 of the plug housing 1490 may be inserted into the cavity 1704 before the armature connector 1610 is so installed onto the end of the armature 1665 that extends into the armature passage 1556. In such other embodiments, following insertion of the combination of the solenoid 1660, the stop 1550 and the inner portion 1409 into the cavity 1704, the stop 1550 may be moved linearly along the length of inner portion 1409 to cause the armature passage 1556 to become aligned with a connector passage 1706, which is formed through a side wall of the body shell 1770 and intersects with cavity 1704. With the armature passage 1556 and the connector passage 1706 so aligned, the armature connector 1610 may then be threaded onto the end of the armature 1665, thereby extending into the armature passage 1556 to at least the extent required for the armature connector 1610 to pass entirely through the connector passage 1706 such that the entirety of the armature connector 1610 is within cavity 1704 and no part of the armature connector 1610 remains within connector passage 1706.

The body cover 1790 includes an inner end 1709 and a cavity 1708 to receive the body shell 1770 such that, when the lock 1000 is assembled, the body cover 1790 envelopes the body shell 1770. With the body shell 1770 fully inserted into the cavity 1708, a mounting projection 1777 carried on the inner end 1707 of the body shell 1770 may extend through a mounting passage 1797 formed through the inner end 1709 of body cover 1790. With the mounting projection 1777 so extending through the mounting passage 1797, the mounting projection 1777 may be configured to receive the threaded end of a screw (best viewed in FIG. 1A) that retains the body cover 1790 in place such that the body shell 1770 remains enveloped by the body cover 1790, and such that the body cover 1790 is able to turn about the central axis 950 independently of the body shell 1770.

The body cover 1790 may serve a role as protecting the body shell 1770 (and thereby, protecting other components of lock 1000 within body shell 1770) from impacts by loose objects stored within the enclosable space 999. In particular, where the enclosable space 999 is incorporated into a vehicle that is in motion, such loose objects may repeatedly impact components of the lock 1000 that are positioned within the enclosable space 999.

Alternatively or additionally, the body cover 1790 may serve a role as an emergency handle operable from within the enclosable space 999. More specifically, the body cover 1790 may be manually operable as by being turned about the central axis 950 to unlatch the closure 900 to allow a person trapped within the enclosable space 999 to release themselves therefrom. As part of serving in this role, the body cover 1790 may be formed from and/or covered with phosphorescent material that may absorb and re-emit light to allow a person trapped within the enclosable space 999 to see, and therefore more easily find, the body cover 1790 to use in this role of an emergency handle.

Figure 8:
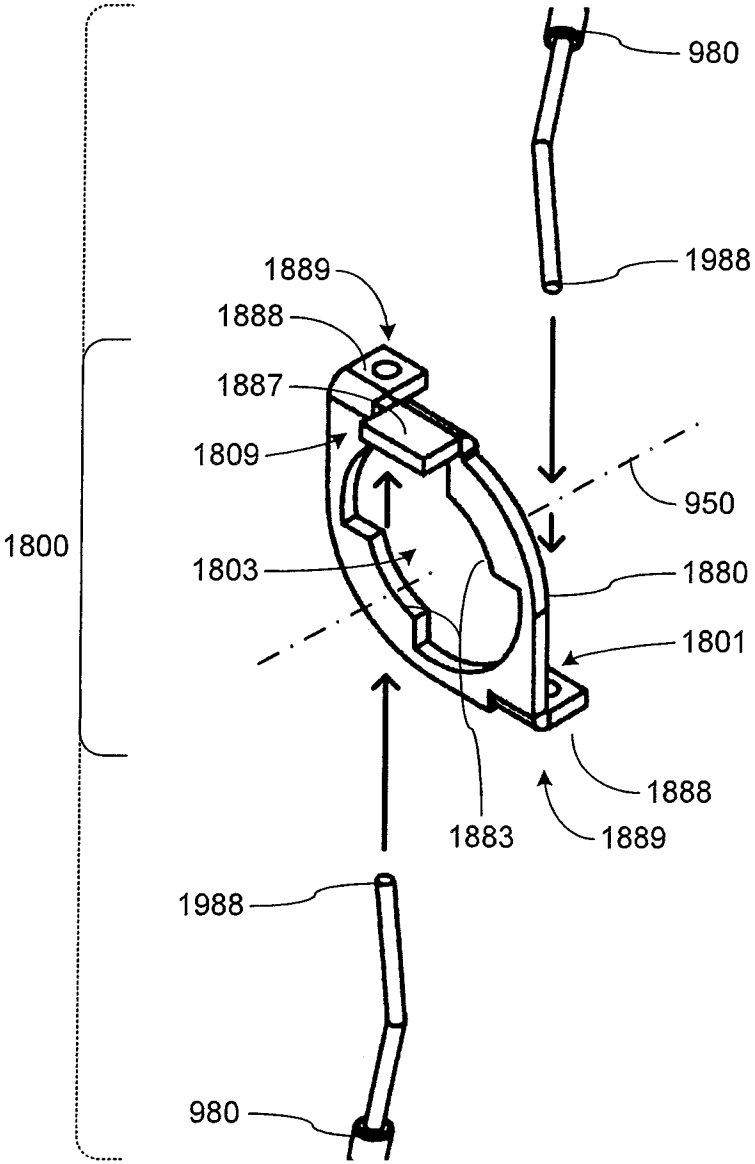
FIG. 8 is an exploded perspective view of a latch assembly of the lock of FIGS. 1A-C, showing details of a latch ring and its connection to the cable ends of a pair of latch cables to the latch ring to enable the latch ring to pull in the latch cables, when turned, to effect unlatching of the closure of FIG. 10.

FIG. 8 depicts aspects of an example embodiment of the latch assembly 1800 for use in pulling in the pair of latch cables 980 to effect unlatching of the closure 900 under the control of either the handle 1200 or the body cover 1790 in its role as an emergency handle. As depicted, the latch assembly 1800 may incorporate a latch ring 1880 and cable ends 1988 of latch cables 980.

The latch ring 1880 may be formed from a stamped piece of sheet metal to have an outer face 1801 and an inner face 1809, and to define a mounting aperture 1803 extending through both faces 1801 and 1809. In assembling the lock 1000, the latch ring 1880 may be sleeved over the locking formation 1315 at the inner end 1309 of the barrel 1310 in a manner that causes the latch ring 1880 to concentrically surround the locking formation 1315 as the locking formation 1315 surrounds the opening into the plug passage 1304 that is formed through the inner end 1309 of the barrel 1310. In being so sleeved over the locking formation 1315, the outer face 1801 of the latch ring 1880 may be caused to rest against the aforementioned annular shoulder that also surrounds the locking formation 1315 on the inner end 1309 of the barrel 1310. The latch ring 1880 may include a pair of engagement formations 1883 that define curved surfaces that extend into the mounting aperture 1803 from opposing edge portions thereof to engage the outer curved surface of the periphery of the locking formation 1315 in a slip fit that allows latch ring 1880 to turn about axis 950 by rotating about locking formation 1315 while resting against the annular shoulder of the inner end 1309.

The latch ring 1880 may incorporate a pair of cable eyelets 1888 with a cable aperture 1889 formed through each to enable each eyelet 1888 to receive the cable end 1988 of one of the pair of latch cables 980 therethrough. As will be familiar to those skilled in the art, any of a variety of approaches may be taken to attaching each of the pair of cable ends 1988 to one of the eyelets 1888, including and not limited to, tying, folding, soldering and/or crimping. With the latch ring 1880 so positioned at the inner end 1309 of the barrel 1310, and with the latch cables 980 so connected to the eyelets 1888 of the latch ring 1880, the latch ring 1880 may be turned in place against the inner end 1309 of the barrel 1310 and about the central axis 950 to pull the latch cables 980 to operate other latch components connected to the opposite ends of the latch cables 980 (e.g., spring-biased latch bolts) to thereby effect unlatching of the closure 900.

The latch ring 1880 may be so turned about the central axis 950 to pull in the latch cables 980 under control of the handle 1200 (i.e., as a result of turning of the handle 1200 about the central axis 950) at times when the lock 1000 is in an unlocked state. The latch ring 1880 may also be turned about the central axis 950 to pull in the latch cables 980 under control of the body cover 1790 in its role as an emergency handle (i.e., as a result of turning of the body cover 1790 about the central axis 950) regardless of whether the lock 1000 is in a locked state or an unlocked state. Either way, a biasing force against such turning of the latch ring 1880 may be applied to the latch ring 1880 through the cable eyelets 1888 and the latch cables 980 by the spring-biased latch components attached to the opposite ends of the latch cables 980. More specifically, the same spring-biasing forces that may be employed by latch components at the opposite ends of the latch cables 980 to maintain the closure 900 in a latched state may also be relied upon to exert a pulling force on the latch cables 980 that pulls away from the lock 1000.

Where the latch ring 1880 is turned about the central axis 950 (and against such biasing force(s) against such turning as may be applied through latch cables 980) by operation of the handle 1200 when the lock 1000 is in an unlocked state, the latch ring 1880 may be so turned as a result of engagement formations 1778 of body shell 1770 interacting with the engagement formations 1883 of latch ring 1880. More specifically, a pair of engagement formations 1778 may be carried on the outer end 1701 of the body shell 1770, and may extend into the mounting aperture 1803 of the latch ring 1880 at locations enabling engagement with flat surfaces of the engagement formations 1883. When the body shell 1770 is caused to turn about the central axis 950 with the solenoid 1660, the stop 1550, the plug housing 1490 and the handle housing 1220 as a result of manual operation of the handle 1200, the engagement formations 1778 may turn within the mounting aperture 1803 about the central axis 950 and into engagement with flat surfaces of the engagement formations 1883 to turn the latch ring 1880 to cause pulling in of the latch cables 980 against such biasing force as may be exerted on the latch cables 980 by other latch components at opposite ends of the latch cables 980 to effect unlatching of the closure 900. As previously discussed, the limiting formation 1223 of the inwardly extending portion 1209 of the handle housing 1220 and the corresponding limiting formation 1312 at the outer end 1301 of the barrel 1310 may interact to limit the extent of such turning, which may aid in avoiding pulling in the latch cables 980 toward lock 1000 by too great an extent such that damage may be done to the latch cables 980 and/or the other latch components at the opposite ends of the latch cables 980.

Where the latch ring 1880 is turned about the central axis 950 (and against such biasing force(s) against such turning as may be applied through latch cables 980) by operation of the body cover 1790 in its role as an emergency handle, the latch ring 1880 may be so turned as a result of a pair of mating formations 1798 within the cavity 1708 of the body cover 1790 interacting with a corresponding mating formation 1887 of the latch ring 1880. More specifically, the mating formation 1887 carried by the latch ring 1880 may extend inwardly (in parallel with the central axis 950) from the latch ring 1880 and into a location between the mating formations 1798 carried within the cavity 1708 of the body cover. When the body cover 1790 is caused to turn about the central axis 950 as by being operated as an emergency handle from within the enclosable space 999, the mating formations 1798 may also turn about the central axis 950 with, while exerting force upon, the mating formation 1887 to turn the latch ring 1880 to cause pulling in of the latch cables 980 against such biasing force as may be exerted on the latch cables 980 by other latch components to effect unlatching of the closure 900. The engagement formations 1883 of the latch ring 1880 may additionally interact with the corresponding engagement formations 1778 of the body shell 1770 to limit the extent of such turning, which again, may aid in avoiding pulling in the latch cables 980 toward lock 1000 by too great an extent such that damage may be done to the latch cables 980 and/or the other latch components at the opposite ends of the latch cables 980.

Figure 9A:
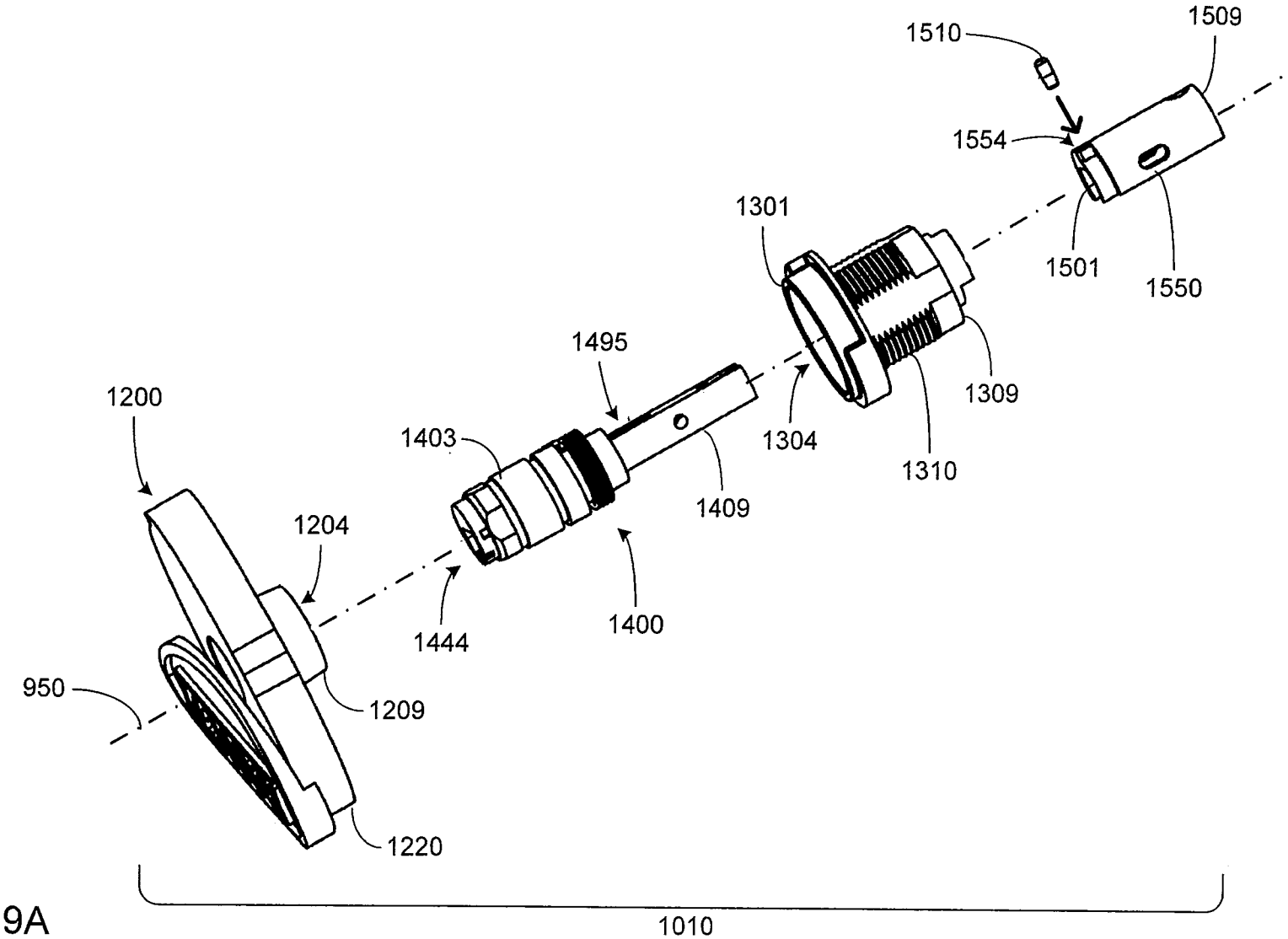
FIGS. 9A, 9B, 9C, 9D and 9E, taken together and in order from FIG. 9A to 9E, provide a series of exploded perspective views of an embodiment of steps for assembling and installing the lock of FIGS. 1A-C, including assembling an outer subassembly, inserting a portion of the outer subassembly through an opening formed through the closure of FIG. 10, securing the outer subassembly in place therein, and completing assembly of the lock as part of completing its installation.
Figure 9B:
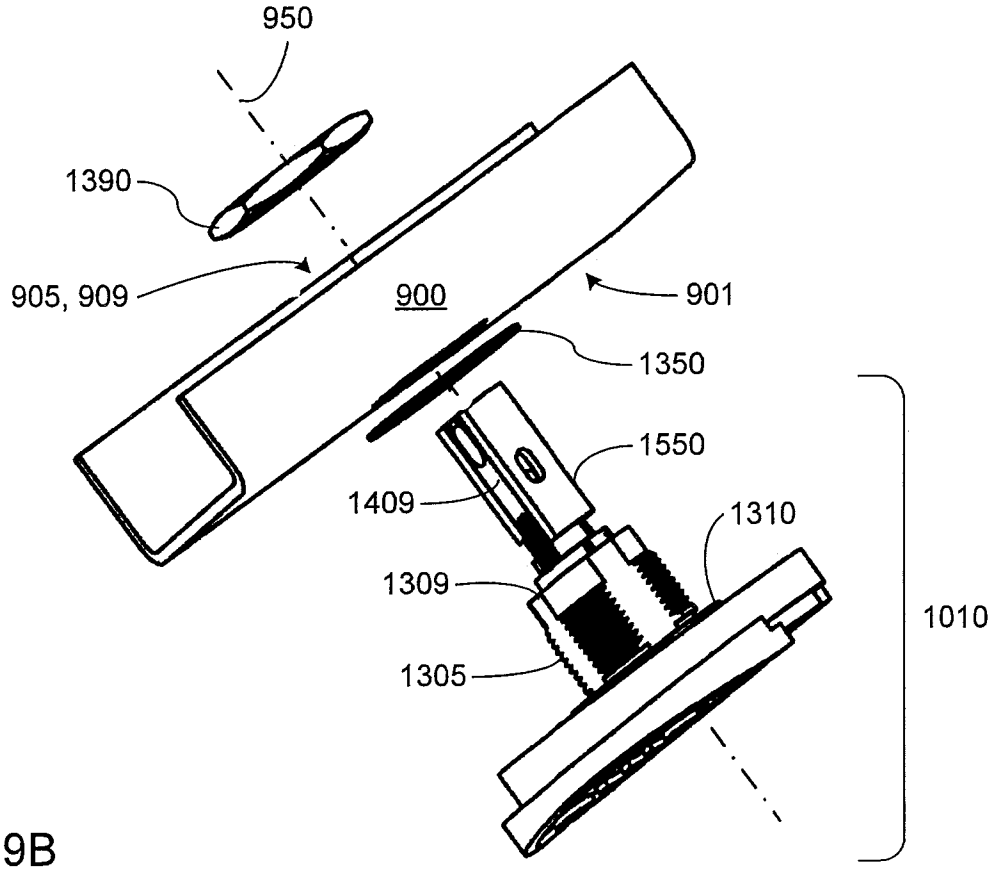
Figure 9C:
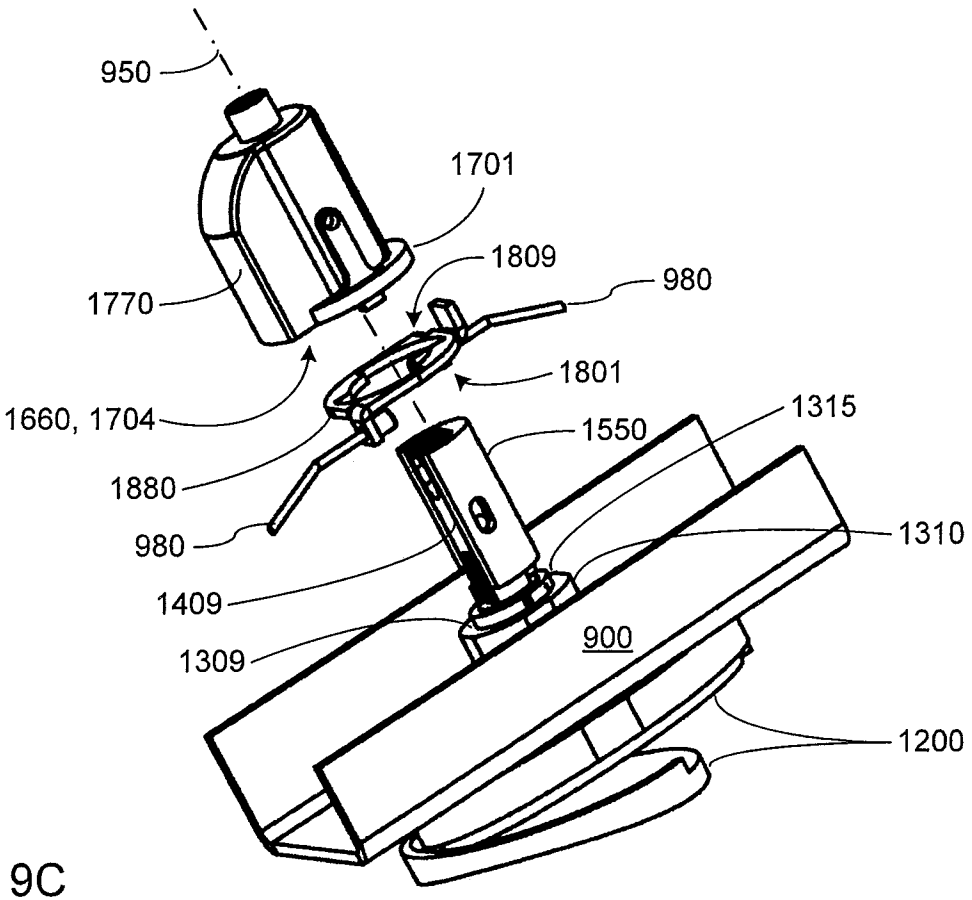
Figure 9D:
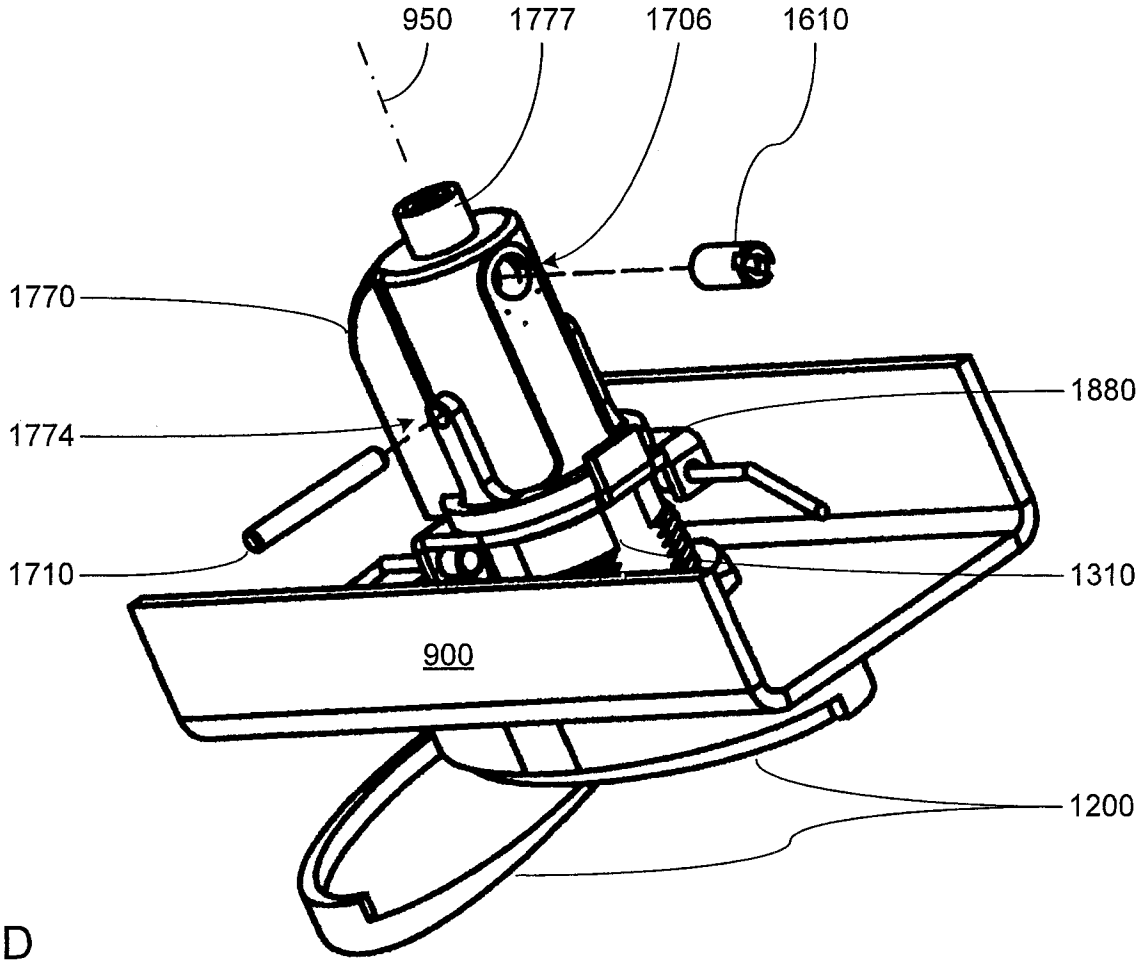
Figure 9E:
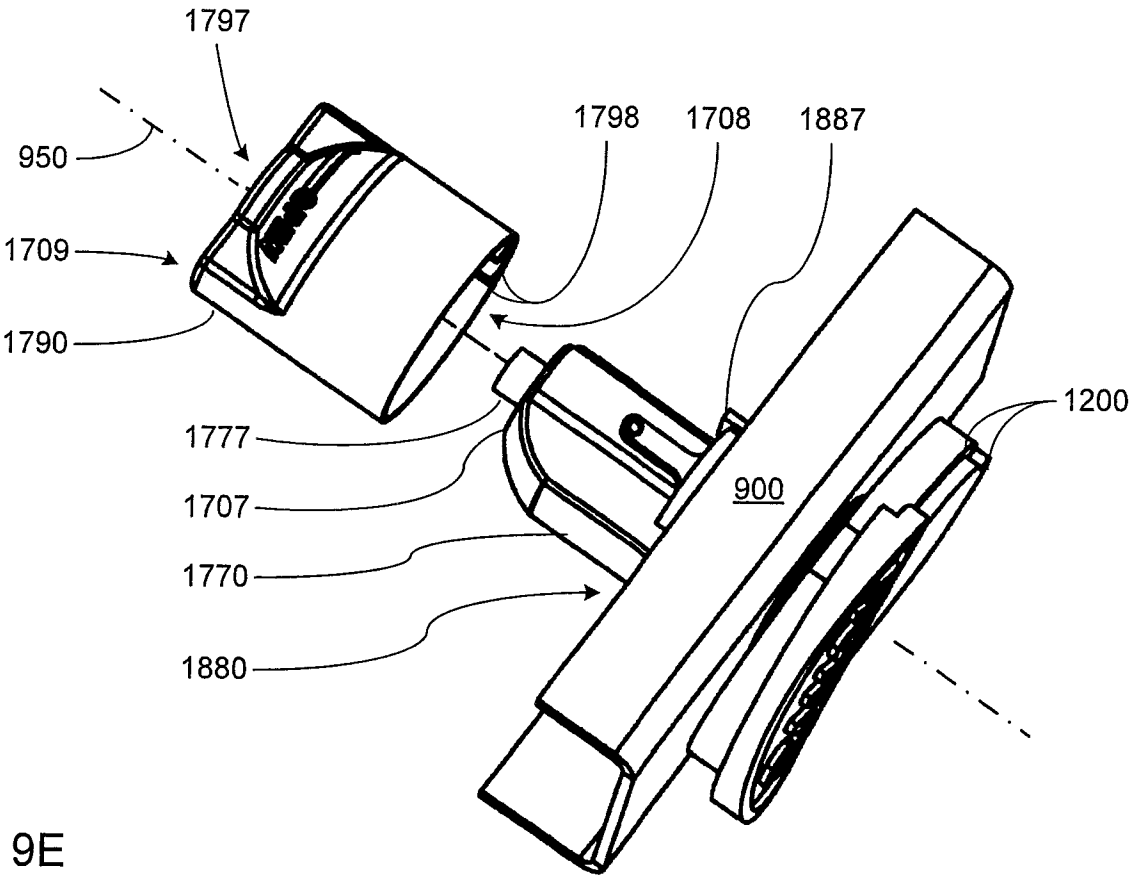

FIGS. 9A through 9E, together, depict aspects of assembling and installing an embodiment of the lock 1000 through the opening 905 of the closure 900. FIG. 9A depicts details of the assembly of an embodiment of an outer subassembly 1010 of the lock 1000 that may include at least the handle 1200, the barrel 1310, the plug assembly 1400, and the stop assembly 1500. FIG. 9B depicts details of the insertion of a portion of the outer subassembly 1010 into the opening 905 of the closure 900, as well as the securing of the outer subassembly 1010 therein. FIGS. 9C through 9E depict aspects of subsequent steps to complete assembly of the lock 1000.

Starting with FIG. 9A, as depicted, with the plug 1444 carried within the plug housing 1490, the outer portion 1403 of the plug housing 1490 may be inserted into the plug passage 1204 through its opening formed through the inwardly extending portion 1209 of the handle housing 1220. With the handle 1200 and the plug assembly 1400 so assembled, the inner portion 1409 of the plug housing 1490 may be inserted into the plug passage 1304 through its opening formed through the outer end 1301 of the barrel 1310. With the plug housing 1490 inserted through the plug passage 1304 far enough that the inner portion 1409 of the plug housing 1490 extends inwardly beyond the inner end 1309 of the barrel 1310, the stop 1550 may be sleeved onto the inner portion 1409 of plug housing 1490. With the stop 1550 so sleeved onto the inner portion 1409 of the plug housing 1490 far enough that the pin passage 1554 of the stop 1550 aligns with the pin slot 1495 of plug housing 1490, the stop pin 1510 may be inserted through the pin passage 1554 and into the pin slot 1495 far enough to engage the helical groove 1405 of the plug 1444 within the plug housing 1490.

As previously discussed, the location and orientation of the plug passage 1304 through the barrel 1310 may define the location and orientation of the central axis 950. As also previously discussed, the plug housing 1490 is received within the plug passage 1304 in a manner that allows the plug housing 1490 to turn about the central axis 950 within the plug passage 1304.

Turning next to FIG. 9B, as depicted, following such assembly of the outer subassembly 1010, the combination of the stop assembly 1500 and the inner portion 1409 of plug housing 1490 of the outer subassembly 1010 may be inserted through the barrel gasket 1350 and then through the opening 905 formed through a portion of the closure 900. Such insertion of the outer subassembly 1010 through the opening 905 may be far enough to sandwich the barrel gasket 1350 between a portion of the outer surface 901 of the closure 900 that surrounds the opening 905 and the shoulder 1305 of barrel 1310. With the outer subassembly 1010 so inserted, the barrel nut 1390 may be threaded onto the barrel 1310 far enough for the barrel nut 1390 to be pressed against a portion of the inner surface 909 of the closure 900 that surrounds the opening 905.

As previously discussed, the mounting of the barrel 1310 (as just described) within the opening 905 of the closure 900 may set the location and orientation of the central axis 950 relative to the closure 900. Thus, the installation of at least the outer subassembly 1010 onto the closure 900 defines the location and orientation, relative to the closure 900, of the rotary movements made by numerous components of the lock 1000 in being operated to selectively place the lock 1000 in a locked state or unlocked state, and in being operated to unlatch the closure 900.

Turning next to FIG. 9C, as depicted, following such threading of the barrel nut 1390 onto the barrel 1310, the latch ring 1880 may be sleeved over the combination of the stop 1550 and inner portion 1409 of plug housing 1490 far enough to position the outer face 1801 of latch ring 1880 against the annular shoulder that surrounds the locking formation 1315 at the inner end 1309 of the barrel 1310, and far enough to surround and engage the curved outer surface of the locking formation 1315 at the inner end 1309 in a slip fit that enables the latch ring 1880 to turn about the locking formation 1315, and thereby turn about the central axis 950. With the latch ring 1880 so positioned, the body shell 1770, with the solenoid 1660 already positioned within the cavity 1704 thereof, may be sleeved over the combination of the stop 1550 and the inner portion 1409 of the plug housing 1490 in a manner that puts the solenoid 1660 and the stop 1550 on opposite sides of the inner portion 1409 of the plug housing 1490. Also, the body shell may be sleeved over the combination of the stop 1550 and the inner portion 1409 far enough to bring the outer end 1701 of the body shell 1770 into contact with the inner face 1809 of the latch ring 1880 to hold the latch ring 1880 in place about the locking formation 1315 and against the annular shoulder that surrounds the locking formation 1315 at the inner end 1309 of the barrel 1310.

Turning next to FIG. 9D, as depicted, at least the stop 1550 and the inner portion 1409 of the plug housing 1490 may be caused to be retained within the cavity 1704 of the body shell 1770 by the insertion of the cross pin 1710 through the pin passages 1774 formed through opposed side walls of the body shell 1770, as well as through portions of the stop 1550 and the inner portion 1409 as has been previously described. With at least the stop 1550 and the inner portion 1409 so retained within the cavity 1704, the armature connector 1610 may be inserted through the connector passage 1706 formed through a portion of the body shell 1770 to connect the armature 1665 of the solenoid 1660 to the stop 1550, as has been previously described.

Turning next to FIG. 9E, as depicted, the body cover 1790 may be sleeved over the body shell 1770 such that the body shell 1770 becomes surrounded and enveloped within the cavity 1708 of the body cover 1790. In so doing, the mounting projection 1777 at the inner end 1707 of the body shell 1770 may extend through the mounting passage 1797 formed through the inner end 1709 of the body cover 1790, thereby aiding in the turning of the body cover about the central axis 950, relative to and independently of, the body shell 1770, and regardless of whether the lock 1000 is in a locked state or an unlocked state. Also in so doing, the mating formations 1798 within the cavity 1708 of the body cover 1790 may surround and engage the mating formation 1887 of the latch ring 1880 such that the body cover 1790 and the latch ring 1880 are caused to turn together about the central axis 950, as has been previously described.

With the lock 1000 so installed onto the closure 900, and with the latch cables 980 connected to the latch ring 1880, as has been previously described, the lock 1000 may be operable to selectively lock and/or to selective unlatch the closure 900.

Figure 10A:
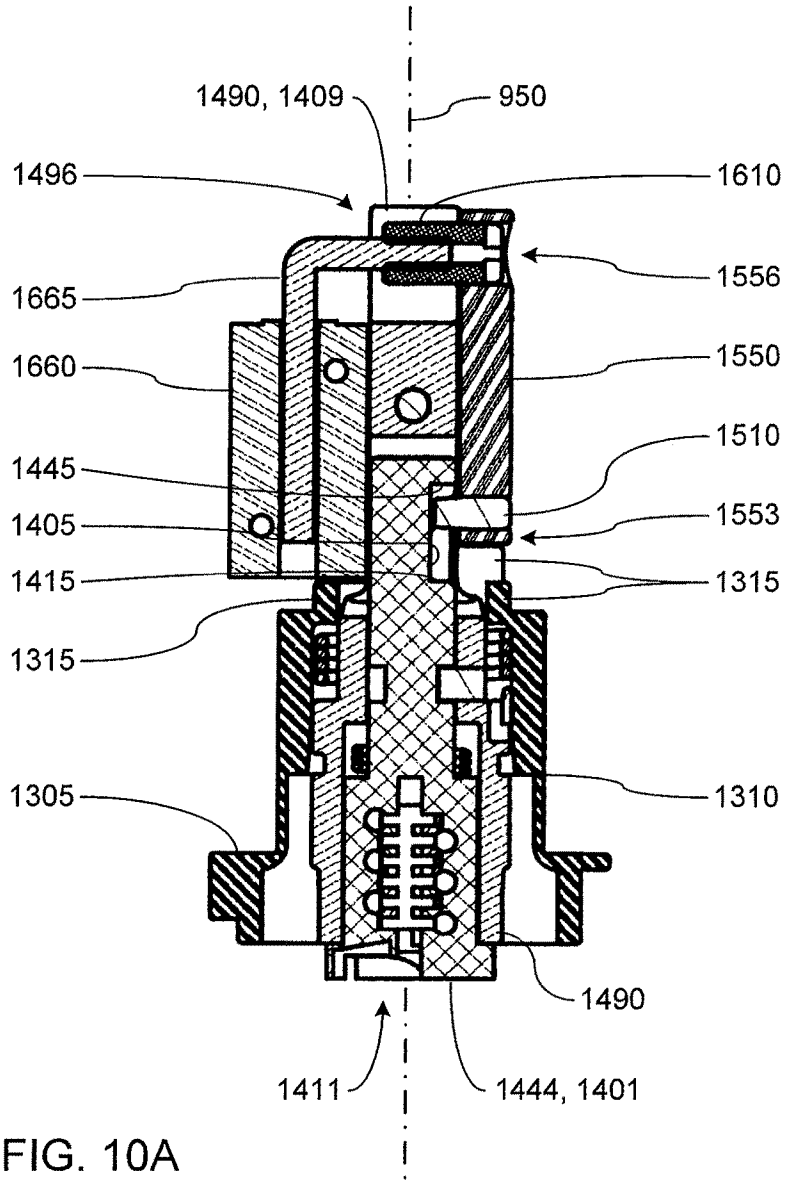
FIG. 10A is a sectional view, taken along a plane that extends along the central axis, of an assembled subset of the components of the lock of FIGS. 1A-C showing details of operating the solenoid of FIG. 6 to place the lock in an unlocked state.
Figure 10B:
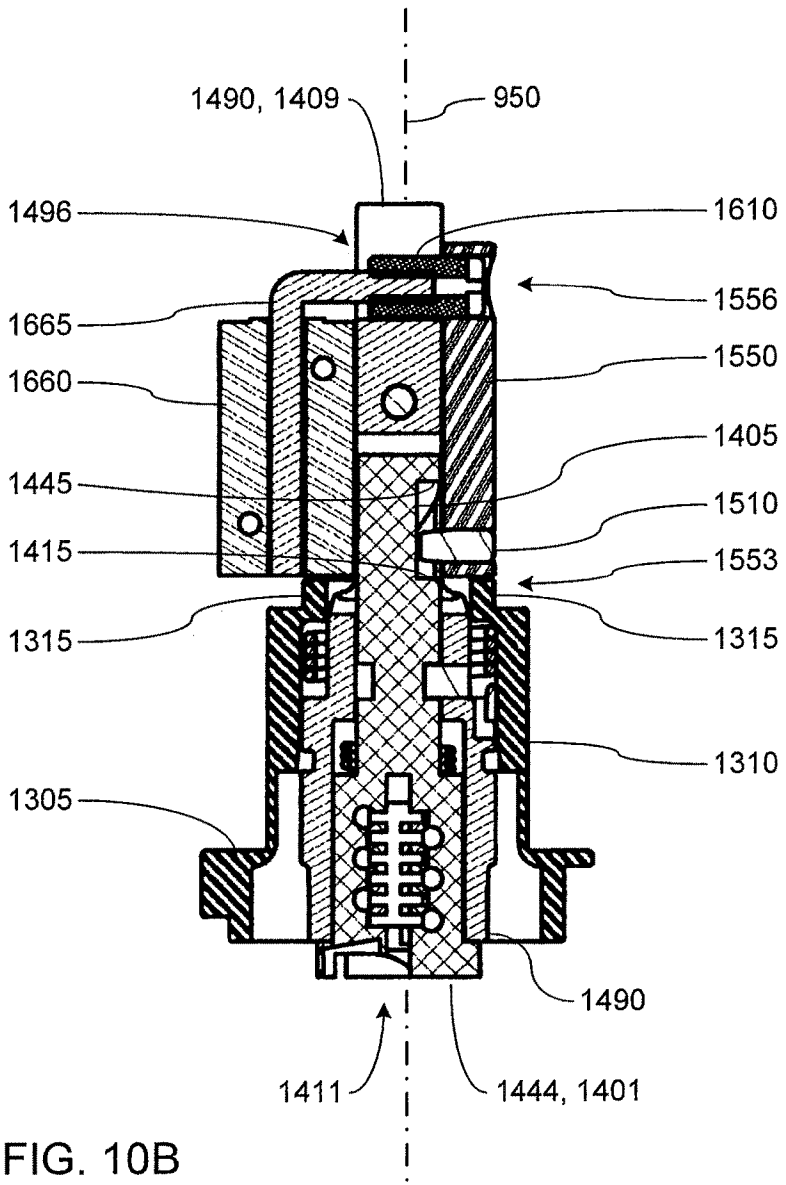
FIG. 10B is a sectional view, similar to FIG. 10A, of the assembled subset of the components of the lock of FIGS. 1A-C showing details of operating the solenoid of FIG. 6 to place the lock in a locked state.

FIGS. 10A and 10B provide cross-sectional views of an assembled subset of the components of the lock 1000 that, together, depict aspects of selectively placing the lock 1000 in a locked state or an unlocked state through operation of the solenoid 1660. FIG. 10A depicts the lock 1000 in an unlocked state. FIG. 10B depicts the lock 1000 in a locked state.

Turning to FIG. 10A, the stop 1550 is depicted as having been linearly moved along the length of the inner portion 1409 of the plug housing 1490, and parallel to the central axis 950, such that the locking formation 1553 of the stop 1550 is pulled away from engagement with the locking formation 1315 of the barrel 1310. As previously discussed, such a lack of engagement between locking formations 1315 and 1553 places lock 1000 in an unlocked state that enables the plug housing 1490 to rotate within the barrel 1310 about the central axis 950. Such enabling of turning of the plug housing 1490 about the central axis 950 enables manual operation of the handle 1200 to rotate the handle 1200 about the central axis 950 to cause, through the plug housing 1490, a combination of the stop 1550, the solenoid 1660, the body shell 1770 and the latch ring 1880 to also rotate about the central axis 950, thereby pulling in the latch cables 980 to effect unlatching of the closure 900.

Turning to FIG. 10B, the stop 1550 is depicted as having been linearly moved along the length of the inner portion 1409 of the plug housing 1490, and parallel to the central axis 950, such that the locking formation 1553 of the stop 1550 is pushed into engagement with the locking formation 1315 of the barrel 1310. As previously discussed, such engagement between the locking formations 1315 and 1553 places the lock 1000 in a locked state that prevents the plug housing 1490 from rotating within the barrel 1310 about the central axis 950. Such prevention of turning of the plug housing 1490 about the central axis 950 prevents manual operation of the handle 1200 to turn the handle 1200 about the central axis 950, such that the stop 1550, the solenoid 1660 and the body shell 1770 are also prevented from being turned about the central axis 950. However, as also previously discussed, despite the lock 1000 having been thusly placed in a locked state, the latch ring 1880 is still able to be turned about the central axis 950 to pull in the latch cables 980 to effect unlatching of the closure 900 as by manual operation of the body cover 1790 in its role as an emergency handle to the turn body cover 1790 about axis 950.

Referring to both FIGS. 10A and 10B, and as previously discussed, such linear movement of the stop 1550, either to pull the locking formation 1553 out of engagement with the locking formation 1315 or to push the locking formation 1553 into engagement with the locking formation 1315, may be caused by operation of the solenoid 1660. As depicted, the helical surfaces 1415 and 1445 of plug 1444 may define the helical groove 1405 to be sufficiently wide in comparison to the width of the stop pin 1510 carried by stop 1550 that the solenoid 1660 is allowed to so move the stop 1550 without interference from either helical surface 1415 or 1445. Stated differently, the helical groove 1405 may be configured to allow a sufficient amount of "play" in the movement of stop pin 1510 within the helical groove 1405 as to allow the stop 1550 to be so moved in parallel with the central axis 950 by the solenoid 1660.

Figure 11A:
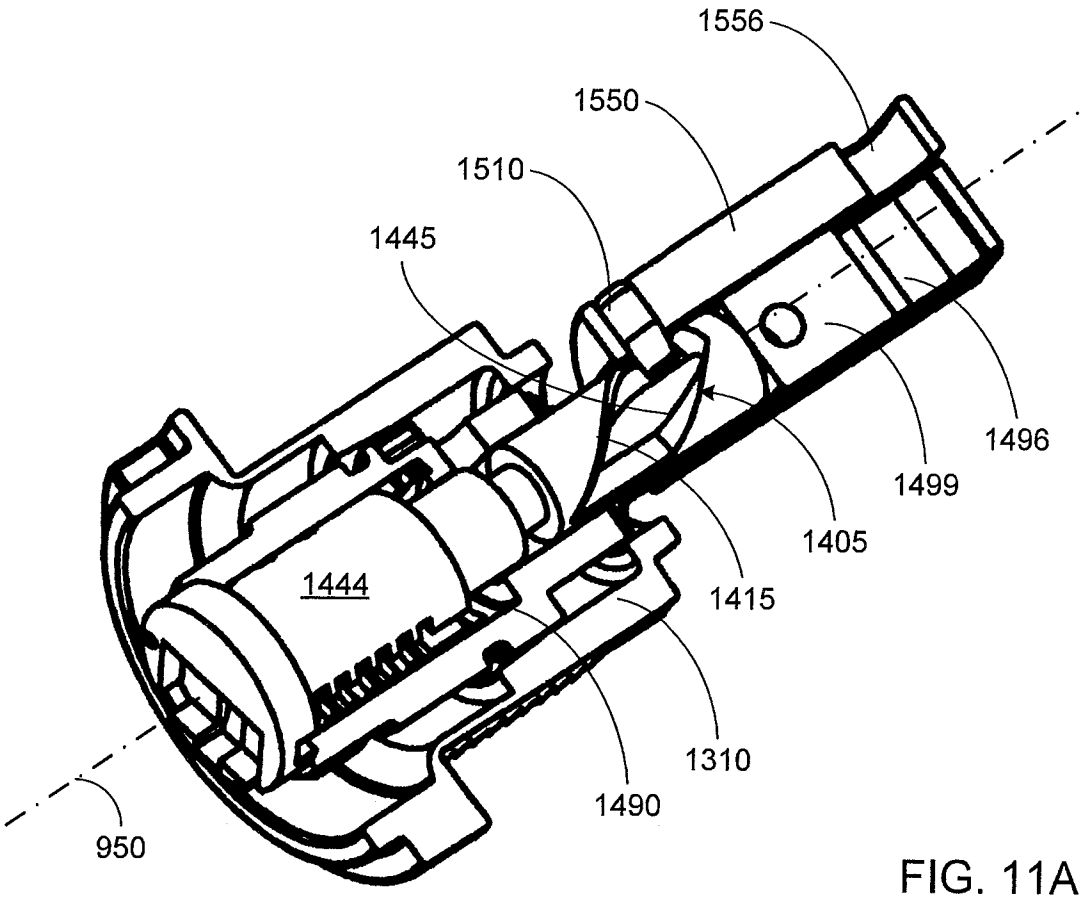
FIGS. 11A and 11B provide perspective views of an assembled subset of components of the lock of FIGS. 1A-C in which portions of components of the lock are cut away along a plane that extends along the central axis, and showing details of placement of the lock in an unlocked state through use of one of the keys of FIGS. 1A-B.
Figure 11B:
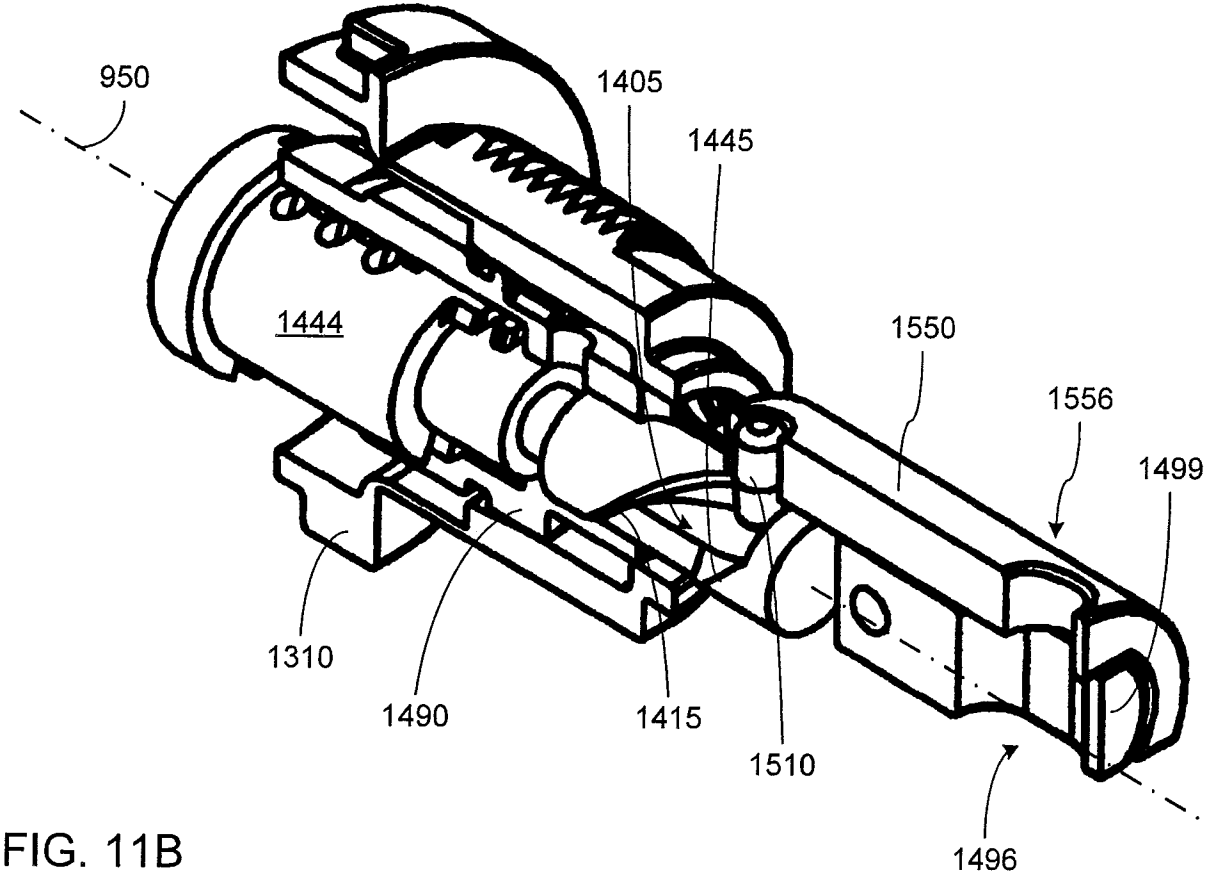
Figure 11C:
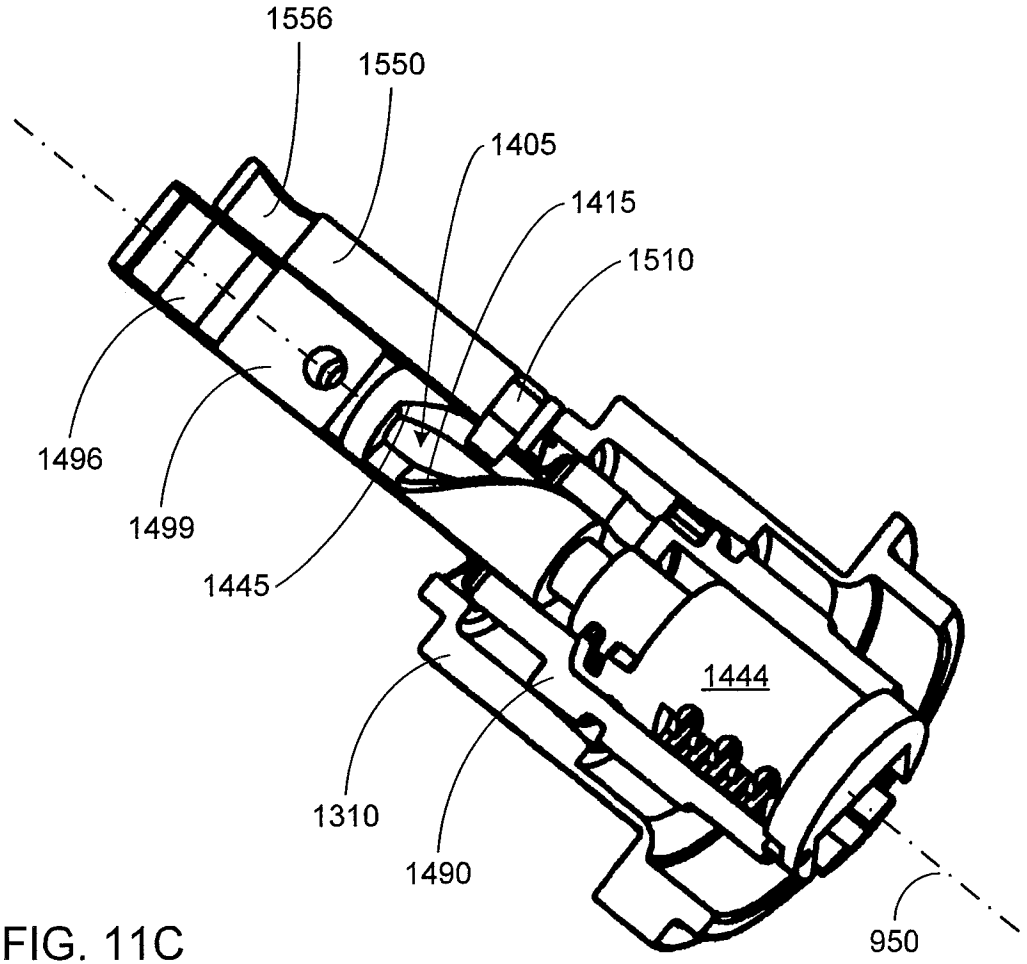
FIGS. 11C and 11D provide perspective views, similar to FIGS. 11A-B, of an assembled subset of components of the lock of FIGS. 1A-C, and showing details of placement of the lock in a locked state through use of one of the keys of FIGS. 1A-B.
Figure 11D:
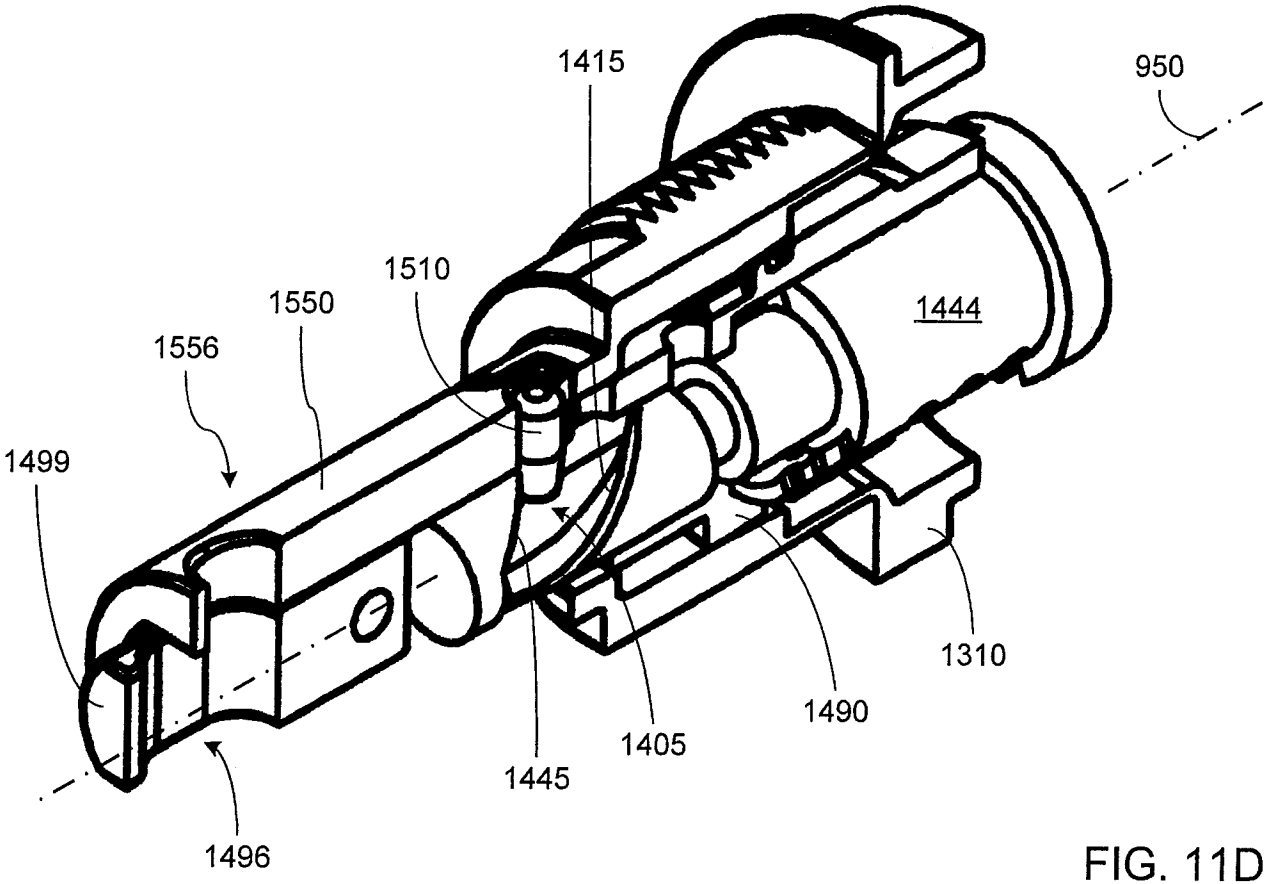

FIGS. 11A through 11D provide perspective views of an assembled subset of components of the lock 1000 with portions of components of the lock 1000 cut away. Together, FIGS. 11A-D depict aspects of selectively placing the lock 1000 in a locked state or unlocked state through use of the key(s) 1100. In each of FIGS. 11A through 11D, parts of the barrel 1310, the plug housing 1490 and the stop 1550 are cut away along a plane that extends along the central axis 950 to enable easier viewing of the interaction between the helical groove 1405 of the plug 1444 and the stop pin 1510 carried by the stop 1550. FIGS. 11A-B depict the lock 1000 in an unlocked state and FIGS. 11C-D depict the lock 1000 in a locked state.

As previously discussed, the helical surfaces 1415 and 1445 may define the helical groove 1405 to be wide enough as to provide a degree of "play" in the interaction between the helical groove 1405 and the stop pin 1510 that allows the solenoid 1660 to also be used to move the stop 1550 linearly along the length of the inner portion 1409 of the plug housing 1490, and parallel with the central axis 950. In this way, either turning of the plug 1444 with one of the keys 1100 or electrical operation of the solenoid 1660 may be used to linearly move the stop 1550 to selectively place the lock 1000 in either an unlocked state or a locked state.

As also previously discussed, in some embodiments, there may be a neutral rotary orientation to which the plug 1444 may be returned under the biasing force of the plug spring 1414 (best viewed in FIG. 4A) after turning of the plug 1444 under control of one of the keys 1100 to selectively place the lock 1000 in either an unlocked state or a locked state. In some embodiments, and regardless of whether the plug spring 1414 is incorporated into the lock 1000, tumblers carried within the tumbler cavity 1412 of the plug 1444 may interact with surface features of the interior of the plug passage 1404 of the plug housing 1490 to enforce a requirement that the plug 1444 be returned to such a neutral rotary orientation before the one of the keys 1100 currently within the keyway 1411 of the plug 1444 is able to be withdrawn from within the keyway 1411. Such a neutral rotary orientation of the plug 1444 may serve to position the helical surfaces 1415 and 1445 in neutral locations needed to ensure that the aforementioned degree of "play" is provided to enable the solenoid 1660 to be used to linearly move the stop 1550, and accordingly, linearly move the stop pin 1510 within the helical groove 1405.

Turning to FIGS. 11A-B, the stop 1550 is depicted as having been linearly moved along the length of the inner portion 1409 of the plug housing 1490, and parallel to the central axis 950, such that the lock 1000 has been placed in an unlocked state. As previously discussed, the plug 1444 may be rotated about the central axis 950, under control of the key(s) 1100 to cause the helical surface 1415 to be rotated into engagement with the stop pin 1510 to push the stop pin 1510 linearly inwardly in parallel with the central axis 950, thereby pushing the stop 1550 linearly inwardly and away from the barrel 1310 (and thereby pulling the locking formation 1553 out of engagement with the locking formation 1315) to place the lock 1000 in an unlocked state. However, as depicted, with the stop pin 1510 and the stop 1550 having been so moved away from the barrel 1310, the plug 1444 has been oppositely rotated about the axis 950 to rotate the helical surface 1415 away from engagement with the stop pin 1510. Thus, an amount of open distance between the helical surface 1415 and the stop pin 1510 (as measured parallel to axis 950) has been provided that may allow the stop pin 1510 to be subsequently moved outwardly in parallel with the central axis 950 as the stop 1550 is moved linearly outwardly and toward the barrel 1310 by the solenoid 1660 (and thereby pushing the locking formation 1553 into engagement with the locking formation 1315) to place the lock 1000 in a locked state.

Turning to FIGS. 11C-D, the stop 1550 is depicted as having been linearly moved along the length of the inner portion 1409 of the plug housing 1490, and parallel to the central axis 950, such that the lock 1000 has been placed in a locked state. As previously discussed, the plug 1444 may be rotated about the central axis 950, under control of the key(s) 1100 to cause the helical surface 1445 to be rotated into engagement with the stop pin 1510 to push the stop pin 1510 linearly outwardly in parallel with the central axis 950, thereby pushing the stop 1550 linearly outwardly and toward the barrel 1310 (and thereby pushing the locking formation 1553 into engagement with the locking formation 1315) to place the lock 1000 in a locked state. FIGS. 11C-D depict such engagement of the stop pin 1510 by the helical surface 1445 to so move the stop pin 1510 and the stop 1550 towards the barrel 1310. Again, following such turning of the plug 1444 to so move the stop pin 1510 and the stop 1550, the plug 1444 may be subsequently oppositely rotated, either under the spring force exerted by the plug spring 1414 (if present) or under control of the key(s) 1100, to return the plug 1444 to a neutral rotary orientation that will open up an amount of open distance between the helical surface 1445 and the stop pin 1510 (as measured parallel to axis 950) to allow the stop pin 1510 to be subsequently moved inwardly in parallel with the central axis 950 as the stop 1550 is moved linearly inwardly and away from barrel 1310 by solenoid 1660 (and thereby pulling the locking formation 1553 away from engagement with the locking formation 1315) to place the lock 1000 in an unlocked state.

Figure 12:
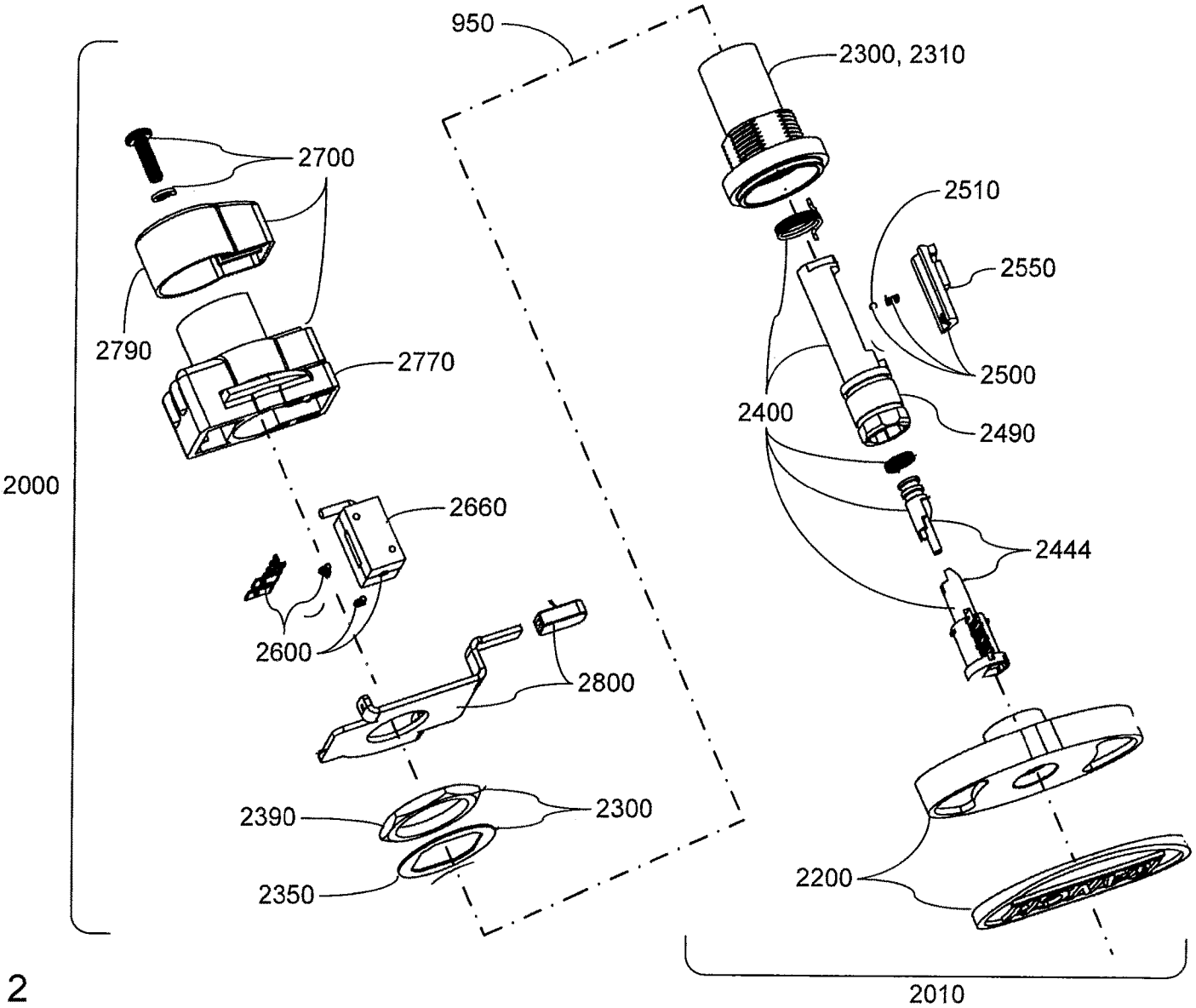
FIG. 12 is an exploded perspective view, similar to FIG. 1A, of most of the components of a second example embodiment of the lock in an unassembled state.

FIG. 12 depicts aspects of an alternate embodiment of an electromechanical lock 2000 that addresses the same aforementioned needs as the earlier presented embodiment of the electromechanical lock 1000, and shares many of the same features therewith. As depicted in FIG. 12, and in a manner closely resembling the lock 1000, the lock 2000 may incorporate one or more keys 2100, a handle 2200, a barrel assembly 2300, a plug assembly 2400, a stop assembly 2500, a solenoid assembly 2600, a body assembly 2700 and a latch assembly 2800. Due to the numerous similarities between the locks 1000 and 2000, components of the lock 2000 that are analogous to components of the lock 1000 have been given reference numerals that differ from the reference numerals given to their counterparts of the lock 1000 only by the substitution of the leading digit "1" with a leading digit "2" throughout.

Analogous to the outer subassembly 1010 of the lock 1000, the lock 2000 includes an outer subassembly 2010 that, when assembled, is able to be partially inserted through a barrel gasket 2350 (corresponding to the barrel gasket 1350) and the opening 905 where the opening 905 opens through the outer surface 901 of the closure 900. Also, with the outer subassembly 2010 so partially inserted, the barrel nut 2390 is able to be threaded onto the barrel 2310 (corresponding to the barrel nut 1390 and the barrel 1310, respectively) to thereby mount the outer subassembly 2010 onto the closure 900.

With the outer subassembly 2010 so mounted, the position and orientation of the barrel 2310 when extending through the opening 905, like the position and orientation of the barrel 1310 when extending through the opening 905, defines the location and orientation of the central axis 950. Also, like the lock 1000, many of the components of the lock 2000 are configured to turn about the central axis 950, both to selectively place the lock 2000 in a locked or unlocked state, and to effect unlatching of the closure 900.

Similar to components of the plug assembly 1400 and the stop assembly 1500 of the lock 1000, components of the plug assembly 2400 and the stop assembly 2500 cooperate to convert turning motion of the plug 2444 about the central axis 950 into linear motion of the stop 2550 in parallel with axis 950. However, whereas stop the 1550 of the lock 1000 carries the stop pin 1510 to interact with the helical groove 1405 of the plug 1444 to perform such a conversion of motion, the stop 2550 carries a spring-projected stop ball 2510 that similarly interacts with a corresponding helical groove of the plug 2444 to perform such a conversion of motion in the lock 2000.

Similar to components of the stop assembly 1500 and the solenoid assembly 1600 of the lock 1000, components of the stop assembly 2500 and the solenoid assembly 2600 cooperate to cause the stop 2550 to be linearly moved in parallel with the central axis 950 by the solenoid 2660 under control of electrical signals received via electrical wires connected to electrical terminals of the solenoid 2660 from another location. However, whereas the stop 1550 and the solenoid 1660 of the lock 1000 are positioned on opposite sides of the inner portion 1409 of the plug housing 1490, the stop 2550 and the solenoid 2660 are positioned alongside each other adjacent to the plug housing 2490 in the lock 2000.

Similar to components of the body assembly 1700 and the latch assembly 1800 of the lock 1000, components of the body assembly 2700 and the latch assembly 2800 cooperate to effect unlatching of the closure 900 by pulling the latch cables 980 inward. However, whereas the latch ring 1880 of the lock 1000 is caused to turn to effect unlatching of the closure 900 by a person within the enclosable space 999 by that person rotating the body cover 1790 about the central axis 950, the latch ring 2880 of the lock 2000 is directly operated by a person within the enclosable space 999 to cause turning thereof about the central axis 950 to effect unlatching of the closure 900. No portion of the body cover 2790 engages the latch ring 2880 to cause turning thereof.

Figure 13A:
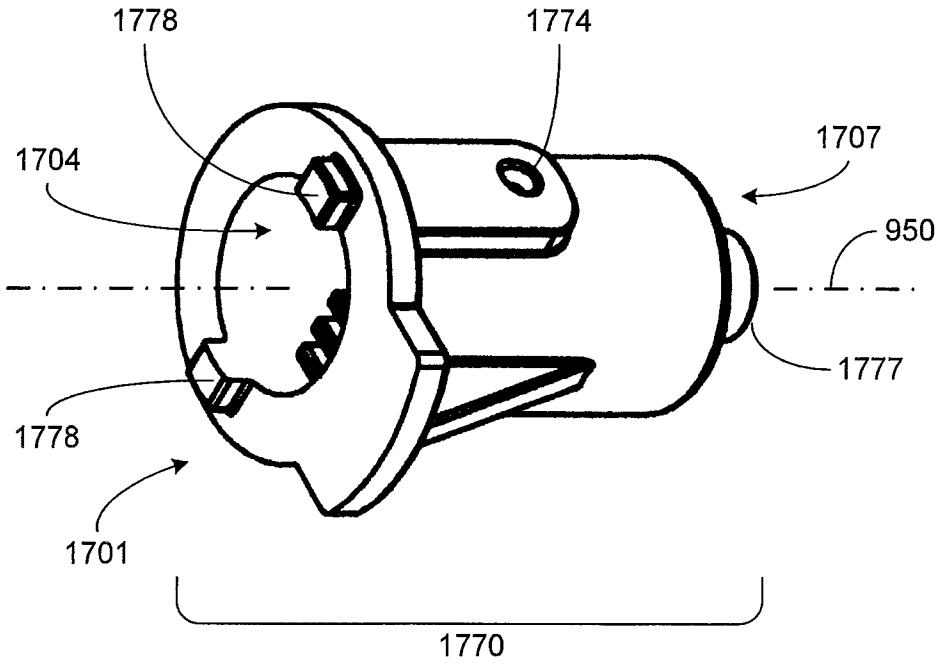
FIG. 13A is a perspective view, from a front end and a side, of an alternate embodiment of the body shell of FIG. 7 for an alternate embodiment of the lock of FIGS. 1A-C that does not include the solenoid assembly of FIG. 6.
Figure 13B:
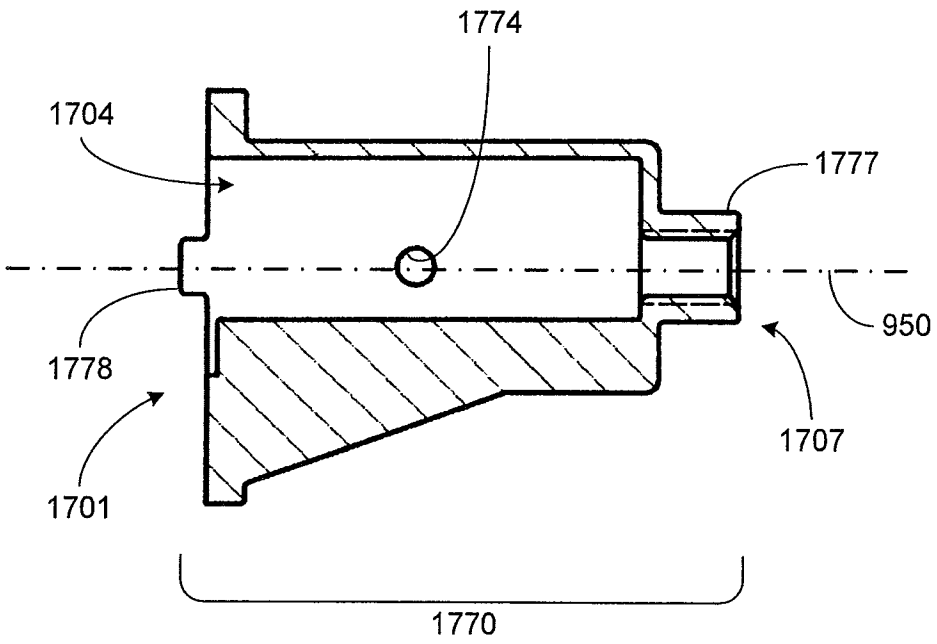
FIG. 13B is a sectional view, taken along a plane that extends along the central axis, of the alternate embodiment of the body shell of FIG. 13A.

FIGS. 13A and 13B, together, depict aspects of an alternate embodiment of the body shell 1770 that shares many of the same features as the embodiment of the body shell 1770 earlier depicted in detail in FIG. 7. As depicted in FIG. 13, and in a manner closely resembling the embodiment of the body shell 1770 of FIG. 7, the embodiment of the body shell 1770 of FIGS. 13A-B may define a cavity 1704 that opens through outer end 1701. However, unlike the embodiment of the body shell 1770 of FIG. 7 that is meant for use in embodiments of electromechanical lock 1000 that include the solenoid 1660 to enable remote electrical operation as has been described, the embodiment of the body shell 1770 of FIGS. 13A-B is meant for use in embodiments of the lock 1000 that do not include the solenoid 1660.

In both embodiments of the body shell 1770 of FIG. 7 and FIGS. 13A-B, the cavity 1704 may also communicate with a screw passage that opens through the mounting projection 1777 at the inner end 1707. Similar to the body shell 1770 of FIG. 7, the body cover 1790 earlier depicted in detail in FIG. 7 may be similarly rotatably mountable onto the body shell 1770 of FIGS. 13A-B at the mounting projection 1777 to enable the body cover 1790 to serve as an inner emergency handle, as has been described. The screw passage opening through the mounting projection 1777 may receive a screw that may be employed in so mounting the body cover 1790 onto the mounting projection 1777 of either embodiment of the body shell 1770.

Although the invention has been described in a preferred form with a certain degree of particularity, it is understood that the present disclosure of the preferred form has been made only by way of example, and that numerous changes in the details of construction and the manner of manufacture may be resorted to without departing from the spirit and scope of the invention. It is intended to protect whatever features of patentable novelty exist in the invention disclosed.

The invention claimed is:

1. An electromechanical lock for installation through an opening formed through a closure of an enclosable space, the lock comprising:

a barrel for extending through and to be secured within the opening formed through the closure, wherein:

the barrel has an inner end configured to extend from the opening and into the enclosable space when the barrel is secured within the opening;

the barrel defines a first locking formation on the inner end of the barrel;

the barrel has an outer end configured to extend from the opening in an opposite direction from the inner end, and away from enclosable space when the barrel is secured within the opening;

the barrel defines a first plug passage that extends through the barrel between the inner and outer ends of the barrel; and the position and orientation of the first plug passage defines the position and orientation of a central axis;

a plug housing for extending through the first plug passage along the central axis and configured to turn within the first plug passage about the central axis to effect unlatching of the closure when the lock is in an unlocked state, wherein:

the plug housing includes an inner end configured to extend from the first plug passage, beyond the inner end of the barrel, and further into the enclosable space when the plug housing is installed within the first plug passage;

the plug housing includes an outer end configured to extend within the first plug passage to at least the outer end of the barrel to provide access to the plug housing from outside the closure to turn the plug housing about the central axis;

with the plug housing defining a second plug passage that extends along the central axis and opens through the outer end of the plug housing;

with the plug housing also defining a pin slot that opens through a side wall of a portion of the inner end of the plug housing that extends beyond the inner end of the barrel; and wherein the pin slot perpendicularly intersects and communicates with the second plug passage;

a plug carried within the second plug passage along the central axis for turning within the second plug passage about the central axis to transition the lock between a locked state wherein the plug housing is prevented from turning about the central axis, and the unlocked state wherein the plug housing is permitted to turn about the central axis to effect unlatching of the closure, wherein:

the plug has an outer portion configured to extend within the second plug passage to at least the outer end of the plug housing to provide access to the plug from outside the closure for turning the plug about the central axis;

the plug also has an inner portion configured to extend within the second plug passage and into the intersection of the second plug passage and the pin slot; and the inner portion of the plug defines a helical groove accessible from outside the inner end of the plug housing through the pin slot; and a stop movable linearly along an external surface of the inner end of the plug housing and parallel to the central axis between an inward position away from the inner end of the barrel, and an outward position toward the inner end of the barrel, wherein:

the stop has a second locking formation configured to be pulled out of engagement with the first locking formation to place the lock in the unlocked state when the stop is moved to the inward position, and to be pushed into engagement with the first locking formation to place the lock in the locked state when the stop is moved to the outward position; and the stop also has a stop pin to extend through the pin slot of the inner end of the plug housing and into the helical groove to be engaged by opposed helical surfaces that define edges of the helical groove to enable turning of the plug about the central axis to cause one of the opposed helical surfaces to move the stop pin linearly in parallel with the central axis to move the stop linearly along the external surface of the inner end of the plug housing between the inward and outward positions.

2. The lock of claim 1, further comprising a barrel nut, wherein:

one of the inner end of the barrel and the outer end of the barrel has a flange-like structure configured to engage a corresponding one of an inner surface of the closure adjacent the opening, and an outer surface of the closure adjacent the opening; and a cylindrical external surface of the barrel has threads onto which the barrel nut is able to be threaded to engage the other of inner surface of the closure adjacent the opening and the outer surface of the closure adjacent the opening to secure the barrel within the opening against at least turning of the barrel within the opening about the central axis.

3. The lock of claim 1, further comprising an external handle configured to be connected to the outer end of the plug housing to cause the external handle and the plug housing to turn together about the central axis when the lock is in the unlocked state, wherein:

the external handle defines a third plug passage extending through the external handle;

the third plug passage is configured to provide access to the plug from outside the closure for turning the plug about the central axis;

the barrel has a first limiting formation on the outer end of the barrel; and the external handle has a second limiting formation to interact with the first limiting formation to limit an extent to which the plug housing and the external handle are able to be turned about the central axis when the lock is in the unlocked state.

4. The lock of claim 3, wherein the external handle comprises a handle cover that is pivotable between a closed position wherein the handle cover blocks access to the third plug passage to prevent exposure of the plug to the environment outside the closure, and an open position wherein the handle cover permits access to the third passage to permit access to the plug from outside the closure for turning the plug about the central axis.

5. The lock of claim 1, wherein:

the plug includes a key cylinder with a keyway formed in the outer portion that is accessible from outside the closure; and the key cylinder includes a spring-biased tumbler configured to interact with an interior surface of the second plug passage within the plug housing to selectively permit the plug to be turned within the second plug passage about the central axis in response to insertion of a key of a preselected configuration.

6. The lock of claim 1, additionally including a solenoid connected to the stop and electrically operable to cause linear movement of the stop between the inward position and the outward position, wherein the opposed helical surfaces are separated by a distance that defines the helical groove to be wide enough to permit the stop pin to move linearly and in parallel with the central axis, and without obstruction by either of the opposed helical surfaces, as the stop is linearly moved by the solenoid between the inward position and the outward position.

7. The lock of claim 6, wherein:

the solenoid and the stop are positioned along opposite sides of the inner end of the plug housing;

an armature extends through a slot formed through the inner end of the plug to engage and linearly move the stop between the inward position and the outward position; and the solenoid and the stop turn together with the plug housing about the central axis when the lock is placed in the unlocked state.

8. The lock of claim 1, further comprising a latch ring, wherein:

the latch ring is connected to at least one latch component that latches the closure in a closed position for closing the enclosable space;

a portion of the latch ring engages a portion of the inner end of the barrel in a slip fit that permits turning of the latch ring relative to the inner end of the barrel to operate the at least one latch component to unlatch the closure; and the latch ring is turnable together with the inner end of the plug housing and the stop about the central axis to operate the at least one latch component to unlatch the closure when the inner end of the plug housing and the stop are turned about the central axis while the lock is in the unlocked state.

9. The lock of claim 8, further comprising a body shell, wherein:

the body shell surrounds at least the inner end of the plug housing and the stop;

the body shell turns with the inner end of the plug housing and the stop about the central axis when the lock is in the unlocked state; and the body shell includes a first engagement formation to engage a second engagement formation of the latch ring to cause the latch ring to turn with the body shell, the inner end of the plug housing and the stop when the inner end of the plug housing and the stop are turned about the central axis while the lock is in the unlocked state.

10. The lock of claim 8, further comprising a body cover, wherein:

the body cover surrounds at least the inner end of the plug housing and the stop;

the body cover is turnable about the central axis independently of the inner end of the plug housing and the stop, and regardless of whether the lock is in the locked state or the unlocked state;

the latch ring is also turnable about the central axis independently of the inner end of the plug housing and the stop, and regardless of whether the lock is in the locked state or the unlocked state; and the body cover comprises a third engagement formation to engage a fourth engagement formation of the latch ring to cause the latch ring to turn with the body cover to enable the body cover to serve as an emergency handle operable from within the enclosable space to cause the latch ring to turn to unlatch the closure regardless of whether the lock is in the locked state or the unlocked state.

11. The lock of claim 8, wherein:

the latch ring is also turnable about the central axis independently of the inner end of the plug housing and the stop, and regardless of whether the lock is in the locked state or the unlocked state; and the latch ring includes an emergency handle operable from within the enclosable space to cause the latch ring to turn to unlatch the closure regardless of whether the lock is in the locked state or the unlocked state.

12. An electromechanical lock for installation through an opening formed through a closure of an enclosable space, the lock comprising:

a plug housing turnable about a central axis of the lock to cause unlatching of the closure when the lock is in an unlocked state, wherein:

the plug housing includes an inner end configured to extend into the enclosable space when the lock is installed within the opening formed through the closure;

the plug housing includes an outer end configured to extend outside of the closure when the lock is installed within the opening formed through the closure to provide access to the plug housing from outside the closure to turn the plug housing about the central axis;

the plug housing defines a plug passage that extends along the central axis and opens through the outer end of the plug housing;

the plug housing defines a pin slot that opens through a side wall of a portion of the inner end of the plug housing that extends beyond the inner end of a barrel; and the pin slot perpendicularly intersects and communicates with the plug passage;

a plug configured to be carried within the plug passage along the central axis and configured to turn within the plug passage about the central axis to transition the lock between a locked state wherein the plug housing is prevented from turning about the central axis, and the unlocked state wherein the plug housing is permitted to turn about the central axis to cause unlatching of the closure, wherein:

the plug has an outer portion configured to extend within the plug passage to at least the outer end of the plug housing to provide access to the plug from outside the closure to turn the plug about the central axis;

the plug also has an inner portion configured to extend within the plug passage and into the intersection of the plug passage and the pin slot; and the inner portion of the plug defines a helical groove accessible from outside the inner end of the plug housing through the pin slot;

a stop movable linearly along an external surface of the inner end of the plug housing and parallel to the central axis between an inward position away from the inner end of the barrel, and an outward position toward the inner end of the barrel, wherein:

the stop has a locking formation configured to be pulled out of engagement with another locking formation to place the lock in the unlocked state when the stop is moved to the inward position, and to be pushed into engagement with the other locking formation to place the lock in the locked state when the stop is moved to the outward position; and the stop also has a stop pin to extend through the pin slot of the inner end of the plug housing and into the helical groove to be engaged by opposed helical surfaces that define opposed edges of the helical groove to enable turning of the plug about the central axis to cause one of the opposed helical surfaces to move the stop pin linearly in parallel with the central axis to move the stop linearly along the external surface of the inner end of the plug housing between the inward and outward positions; and a solenoid connected to the stop and electrically operable to cause linear movement of the stop between the inward position and the outward position, wherein the opposed helical surfaces are separated by a distance that defines the helical groove to be wide enough to enable the stop pin to move without obstruction by either of the opposed helical surfaces linearly and in parallel with the central axis as the stop is linearly moved by the solenoid between the inward position and the outward position.

13. The lock of claim 12, wherein:

the plug includes a key cylinder with a keyway formed in the outer portion that is accessible from outside the closure; and the key cylinder includes a spring-biased tumbler that is configured to interact with an interior surface of the plug passage within the plug housing to selectively permit the plug to be turned within the plug passage about the central axis in response to insertion of a key of a preselected configuration.

14. The lock of claim 12, wherein:

the solenoid and the stop are positioned along opposite sides of the inner end of the plug housing;

a armature extends through a slot formed through the inner end of the plug housing to engage and linearly move the stop between the inward position and the outward position; and the solenoid and the stop turn with the plug housing about the central axis when the lock is placed in the unlocked state.

15. The lock of claim 12, further comprising the barrel to secure the lock within the opening formed through the closure, wherein:

the barrel has an inner end configured to extend from the opening and into the enclosable space when the barrel is secured within the opening;

the barrel carries the other locking formation on the inner end of the barrel;

the barrel also has an outer end configured to extend from the opening in an opposite direction from the inner end, and away from enclosable space when the barrel is secured within the opening;

the position and orientation of the barrel defines the position and orientation of a central axis; and the plug housing extends through the barrel with the inner end of the plug housing extending beyond the inner end of the barrel and further into the enclosable space, and with the outer end of the plug housing extending to at least the outer end of the barrel to provide access to the plug housing to provide access to the plug housing from outside the closure.

16. The lock of claim 15, further comprising a barrel nut, wherein:

one of the inner end of the barrel and the outer end of the barrel carries a flange-like structure to engage a corresponding one of an inner surface of the closure adjacent the opening and an outer surface of the closure adjacent the opening; and a cylindrical external surface of the barrel has threads onto which the barrel nut is able to be threaded to engage the other of inner surface of the closure adjacent the opening and the outer surface of the closure adjacent the opening to secure the barrel within the opening, and to prevent turning of the barrel within the opening about the central axis.

17. The lock of claim 15, further comprising an external handle configured to be connected to the outer end of the plug housing to cause the external handle and the plug housing to turn together about the central axis when the lock is in the unlocked state, wherein:

the barrel has a first limiting formation on the outer end of the barrel; and the external handle has a second limiting formation configured to interact with the first limiting formation to limit an extent to which the plug housing and the external handle can be turned about the central axis when the lock is in the unlocked state.

18. The lock of claim 17, wherein the external handle includes a handle cover that is pivotable between a closed position at which the handle cover blocks access to the plug to prevent exposure of the plug to the environment outside the closure, and an open position at which the handle cover provide access to the plug to provide access to the plug from outside the closure to turn the plug about the central axis.

19. The lock of claim 12, further comprising a latch ring, wherein:

the latch ring is connected to at least one latch component that latches the closure in a closed position to close the enclosable space;

a portion of the latch ring engages a portion of the inner end of the barrel in a slip fit that enables the latch ring to turn relative to the inner end of the barrel to operate the at least one latch component to unlatch the closure; and the latch ring is configured to be turnable, together with the inner end of the plug housing and the stop, about the central axis to operate the at least one latch component to unlatch the closure when the inner end of the plug housing and the stop are turned about the central axis while the lock is in the unlocked state.

20. The lock of claim 19, further comprising a body shell, wherein:

the body shell surrounds at least the inner end of the plug housing and the stop;

the body shell turns with the inner end of the plug housing and the stop about the central axis when the lock is in the unlocked state; and the body shell comprises a first engagement formation to engage a second engagement formation of the latch ring to cause the latch ring to turn with the body shell, the inner end of the plug housing and the stop when the inner end of the plug housing and the stop are turned about the central axis while the lock is in the unlocked state.

21. The lock of claim 19, further comprising a body cover, wherein:

the body cover surrounds at least the inner end of the plug housing and the stop;

the body cover is turnable about the central axis independently of the inner end of the plug housing and the stop, and regardless of whether the lock is in the locked state or the unlocked state;

the latch ring is also turnable about the central axis independently of the inner end of the plug housing and the stop, and regardless of whether the lock is in the locked state or the unlocked state; and the body cover comprises a third engagement formation to engage a fourth engagement formation of the latch ring to cause the latch ring to turn with the body cover to enable the body cover to serve as an emergency handle operable from within the enclosable space to cause turning of the latch ring to unlatch the closure regardless of whether the lock is in the locked state or the unlocked state.

22. The lock of claim 19, wherein:

the latch ring is also turnable about the central axis independently of the inner end of the plug housing and the stop, and regardless of whether the lock is in the locked state or the unlocked state; and the latch ring comprises an emergency handle operable from within the enclosable space to cause turning of the latch ring to unlatch the closure regardless of whether the lock is in the locked state or the unlocked state.

* * * * *